US006742457B2

(12) United States Patent
Shiroza

(10) Patent No.: US 6,742,457 B2
(45) Date of Patent: Jun. 1, 2004

(54) TRANSFER PRESS AND METHOD OF DRIVING ITS SLIDES

(75) Inventor: Kazuhiko Shiroza, Komatsu (JP)

(73) Assignee: Komatsu Ltd., Tokyo (JP)

( * ) Notice: Subject to any disclaimer, the term of this patent is extended or adjusted under 35 U.S.C. 154(b) by 0 days.

(21) Appl. No.: 10/122,172

(22) Filed: Apr. 16, 2002

(65) Prior Publication Data

US 2002/0157556 A1 Oct. 31, 2002

(30) Foreign Application Priority Data

Apr. 18, 2001 (JP) ..... 2001-119588

(51) Int. Cl.[7] ..... B41L 1/02; B21J 11/00

(52) U.S. Cl. ..... 101/485; 72/405.09

(58) Field of Search ..... 101/485, 483, 101/248, 286; 414/733, 737, 739, 740, 749, 752, 977; 100/137, 207, 214, 231, 232, 257, 918; 72/404, 405.01, 405.09, 405.13, 405.16, 429, 441, 446

(56) References Cited

U.S. PATENT DOCUMENTS

| | | | | |
|---|---|---|---|---|
| 3,967,483 A | * | 7/1976 | Kuroyahagi et al. | 72/17.2 |
| 4,089,205 A | * | 5/1978 | Mizumoto et al. | 72/450 |
| 4,585,389 A | * | 4/1986 | Watanabe et al. | 198/750.12 |
| 4,770,572 A | * | 9/1988 | Ohkawa et al. | 409/60 |
| 4,957,019 A | * | 9/1990 | Kubo | 74/665 H |
| 4,995,255 A | * | 2/1991 | Noda | 72/446 |
| 5,586,495 A | | 12/1996 | Ogawa et al. | |
| 5,913,932 A | * | 6/1999 | Takayama | 72/405.09 |
| 6,101,861 A | * | 8/2000 | VanderZee et al. | 72/405.01 |
| 6,520,074 B1 | * | 2/2003 | Sunata et al. | 100/137 |

* cited by examiner

*Primary Examiner*—Charles H. Nolan, Jr.
*Assistant Examiner*—Hoai-An D. Nguyen
(74) *Attorney, Agent, or Firm*—Varndell & Varndell, PLLC

(57) ABSTRACT

A transfer press having a plurality of slides, and comprising slide drives being drive sources provided every slide, and a control device for controlling the slide drives to synchronously drive and/or singly drive the slides individually.

23 Claims, 15 Drawing Sheets

TRANSFER PRESS AND METHOD OF DRIVING ITS SLIDES

BACKGROUND OF THE INVENTION

1. Field of the Invention

The invention relates to a transfer press and a method of driving slides thereof, and more particularly, to a transfer press, in which a plurality of slides are provided, and a method of driving slides used in the transfer press, or to a transfer press, in which a plurality of units each composed of a crown, slide and a bed are arranged linearly and uprights are provided between adjacent units to be common thereto, and a method of driving slides used in the transfer press.

2. Description of the Related Art

Conventionally, a transfer press has been known, in which slides conformed to at least one working station. Such transfer press is frequently used in the case where stations are large in number, the case where workpieces are large in size, the case where an overall pressing force is great, or the case where a blanking station is provided for use of a coiled stock.

In such transfer press, respective slides are driven substantially at the same time by one main motor common to all the slides. Also, provided in the transfer press are a set of a flywheel rotated constantly by the main motor, a clutch for intermittently transmitting energy of the flywheel to the respective slides, and a brake for stoppage of movements of the slides, in addition to the main motor.

Also, in recent years, a transfer press has been known, in which units each composed of a set of a crown, slide and a bed are modularized and uprights are provided between adjacent units to be common thereto. In this transfer press, combination of the modularized units in accordance with the specification of the press enables achieving an improvement in use for various purposes, which is achieved by diversification in need and easiness in modification of specification, cost reduction and an improvement in property of transportation.

In such transfer press, slides in the respective units are also driven substantially at the same time by one main motor common to all the units. Also, provided in transfer press are a set of a flywheel rotated constantly by a main motor, a clutch for intermittently transmitting energy of the flywheel to the respective slides, and a brake for stoppage of movements of the slides, in addition to the main motor.

In the above-mentioned transfer press, however, all the slides are driven at the same time by one main motor, so that the main motor is made large in size and the flywheel, clutch and the brake are also made large in size. Accordingly, there is caused a problem that purchasing of these parts involves much labor and high cost, for example, production is impeded because the transfer press cannot but be stopped for a long period of time in the case where these parts must be exchanged in a transfer press actually in use.

Also, since all the slides in the transfer press are driven substantially at the same time without phase difference, restrictions are imposed on manufacture of metallic molds and configuration of workpieces, thus causing a problem that various workings cannot be accommodated.

SUMMARY OF THE INVENTION

It is an object of the invention to provide a transfer press, in which it is possible to reduce the size of drive means for driving slides and to realize various workings, and a method of driving slides thereof.

A transfer press according to a first aspect of the invention is provided with a plurality of slides, and comprises slide drives being drive sources provided every slide, and control means for controlling the slide drives to synchronously drive and/or singly drive the slides individually.

In the transfer press provided with a plurality of slides, according to the first aspect of the invention, the slide drives containing drive sources are provided every slide, and so the drive source suffices to drive one slide and has no need of so large capacity as that in the prior art, by which considerably small-sized drive sources used for various purposes can be used to reduce labor and cost required for purchasing.

Also, the respective slides are driven in various modes by controlling the slide drives provided every slide.

For example, in addition to the case where the respective slides are driven at the same time as in the prior art (synchronously drive without phase difference), the slides can be synchronously driven with optional phase difference, or stopped a predetermined time every cycle at a top dead point, or singly driven individually. Accordingly, one press can perform working in a tandem press and a single press as well as working of a transfer press, whereby various workings can be accommodated. The above-mentioned object can be attained as described above.

A transfer press according to a second aspect of the invention is one, in which a plurality of units each composed of a crown, a slide and a bed are arranged along a workpiece transfer direction and uprights are provided between adjacent units to be common thereto, and which comprises slide drives being drive sources provided every slide; and control means for controlling the slide drives to synchronously drive and/or singly drive the slides individually.

According to the second aspect of the invention, the slide drives are provided every unit, and so the drive source constituting the slide drive suffices to drive a slide in one unit, by which considerably small-sized drive sources used for various purposes can be used to reduce labor and cost required for purchasing as described with respect to the first aspect of the invention.

Also, control of the slide drives with the control means enables the slides to be synchronously driven with optional phase difference, or stopped a predetermined time every cycle at a top dead point, or singly driven individually, in addition to the case where the slides provided every unit are driven at the same time as in the prior art (synchronously drive without phase difference). Accordingly, by driving the slides with phase differences, which are conformed to levels, at which workpieces are worked, dimensions of metallic molds or the like, or singly driving the slides, one press can achieve working in a tandem press and a single press as well as working of a transfer press, whereby various workings can be accommodated. The above-mentioned object can be attained as described above.

A method of driving slides of a transfer press provided with a plurality of slides, according to a third aspect of the invention, comprises the steps of driving the slides by means of drive sources provided every slide, and controlling slide drives, which include the drive sources, to synchronously drive and/or singly drive the slides individually.

The third aspect of the invention provides a slide driving method that can be realized by means of the transfer press of the first aspect of the invention, and therefore attains the object of the invention as described with respect to the first aspect of the invention. In addition, included in the invention are the case where all the plurality of slides are synchronously driven without phase difference, the case where all the plurality of slides are synchronously driven with predetermined phase differences, the case where all the plurality of slides are singly driven, and the case where synchronous drive without phase difference, synchronous drive with phase difference, synchronous drive, in which the slides are stopped a predetermined time every cycle at a top dead point, and single drive are combined optionally, the single drive including the case where the slides are maintained in stoppage.

A method of driving slides of a transfer press, in which a plurality of units each composed of a crown, a slide and a bed are arranged along a workpiece transfer direction and uprights are provided between adjacent units to be common thereto, according to the third aspect of the invention, comprises the steps of driving the slides by means of drive sources provided every slide, and controlling slide drives, which include the drive sources, to synchronously drive and/or singly drive the slides individually.

The fourth aspect of the invention of provides a slide driving method that can be realized by means of the transfer press of the second aspect of the invention, and therefore attains the object of the invention as described with respect to the second aspect of the invention of. In addition, included in the invention are the case where all the plurality of slides are synchronously driven without phase difference, the case where all the plurality of slides are synchronously driven with predetermined phase differences, the case where all the plurality of slides are singly driven, and the case where synchronous drive without phase difference, synchronous drive with phase difference, synchronous drive, in which the slides are stopped a predetermined time every cycle at a top dead point, and single drive are combined optionally, the single drive including the case where the slides are maintained in stoppage.

A method of driving slides of a transfer press, according to the fifth aspect of the invention, is one according to the third or fourth aspect of the invention, wherein when at least a pair of slides are to be synchronously driven, the slide drives are controlled so that at least a slide is synchronously driven while stopping a predetermined time every cycle at a top dead point.

In such method, it is possible to make a transfer press function as a tandem press, and since idle stations are not necessarily required between the working stations, a space for installation is small and productivity is high.

A method of driving slides of a transfer press, according to a sixth and seventh aspect the invention, is one according to any one of the third through fifth aspects of the invention, where in the case where at least a pair of slides are to be synchronously driven, the slide drives are controlled so that the slides are synchronously driven with phase difference.

In such method, in the case where one slide is driven earlier in phase than the other slides, the one slide has been terminated in working to be returned to a higher level when working in the other slides is terminated. Accordingly, even a workpiece having a larger height of working can be surely transferred in the working station, in which the one slide is present, without interference between the workpiece and a metallic mold.

Also, when phase difference is optionally set in all the units, the transfer press will function as a tandem press, and use of the press for various purposes is surely promoted.

A method of driving slides of a transfer press, according to the invention of any one of seventh through eleventh aspects of the invention, is one according to any one of the third through sixth aspects of the invention, wherein other slides are driven in a state, in which any one slide is stopped.

Such method makes it possible for a transfer press to function as a single press, and stoppage of slides not in use reduces load, for which the slides must be driven, and energy consumption in the slide drives to lead to economy.

A method of driving slides of a transfer press, according to the invention of any one of the 12th through 15th aspects of the invention is one according to any one of the third through seventh aspects of the invention, wherein other slides are driven in a state, in which any one slide is stopped and the drive source therefor is stopped.

A slide can be maintained in stoppage by releasing a clutch so as to prevent energy of a rotating flywheel from being transmitted to the slide side and causing a brake to hold the slide, in which case energy for rotating the flywheel with the use of a drive source is consumed to lead to want of economy.

In contrast, the invention is economical because the drive source is also stopped to eliminate wasteful energy consumption.

Respective embodiments of the invention will be described below with reference to the drawings.

In addition, the same constituent members in second to fourth embodiments described later as those in a first embodiment and constituent members having the same function in the second to fourth embodiments as that of the constituent members in the first embodiment are denoted by the same characters as those in the first embodiment, and an explanation therefor is omitted.

DETAILED DESCRIPTION OF THE PREFERRED EMBODIMENTS

[First Embodiment]

Figure 1:
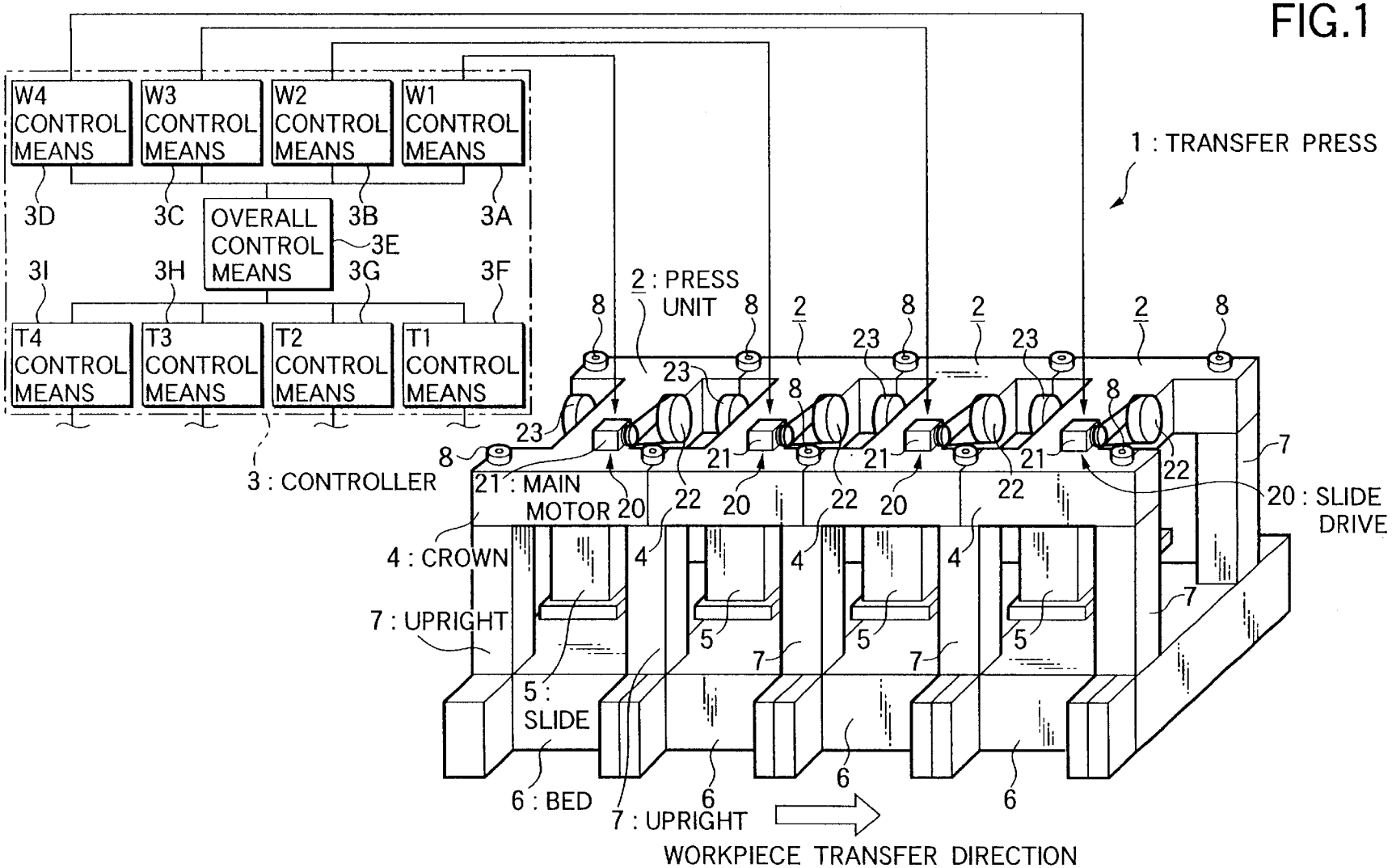
FIG. 1 is a general, perspective view showing a transfer press according to a first embodiment of the invention schematically.
Figure 2:
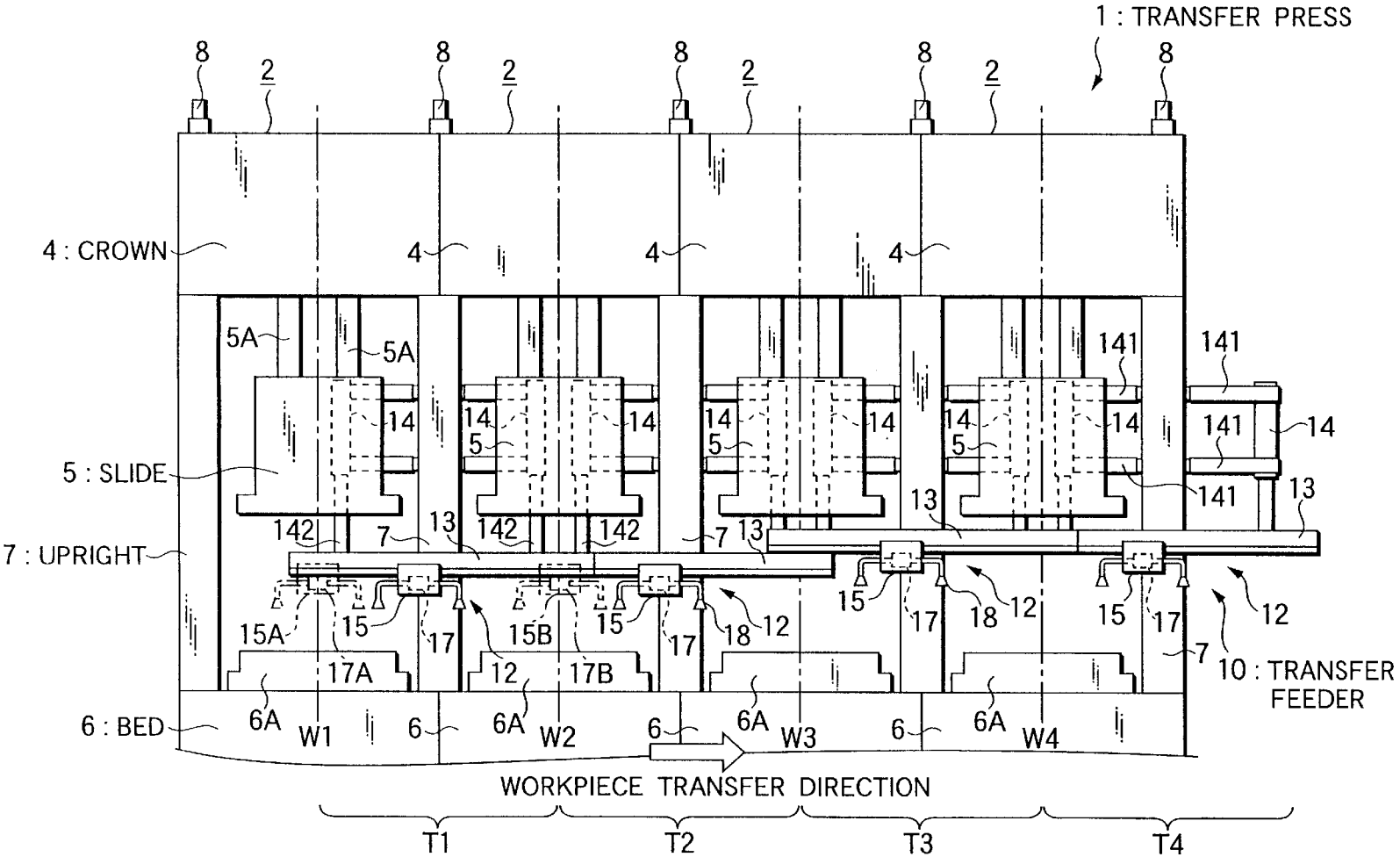
FIG. 2 is a front view showing the transfer press of the first embodiment and an operating configuration of a transfer feeder.
Figure 3:
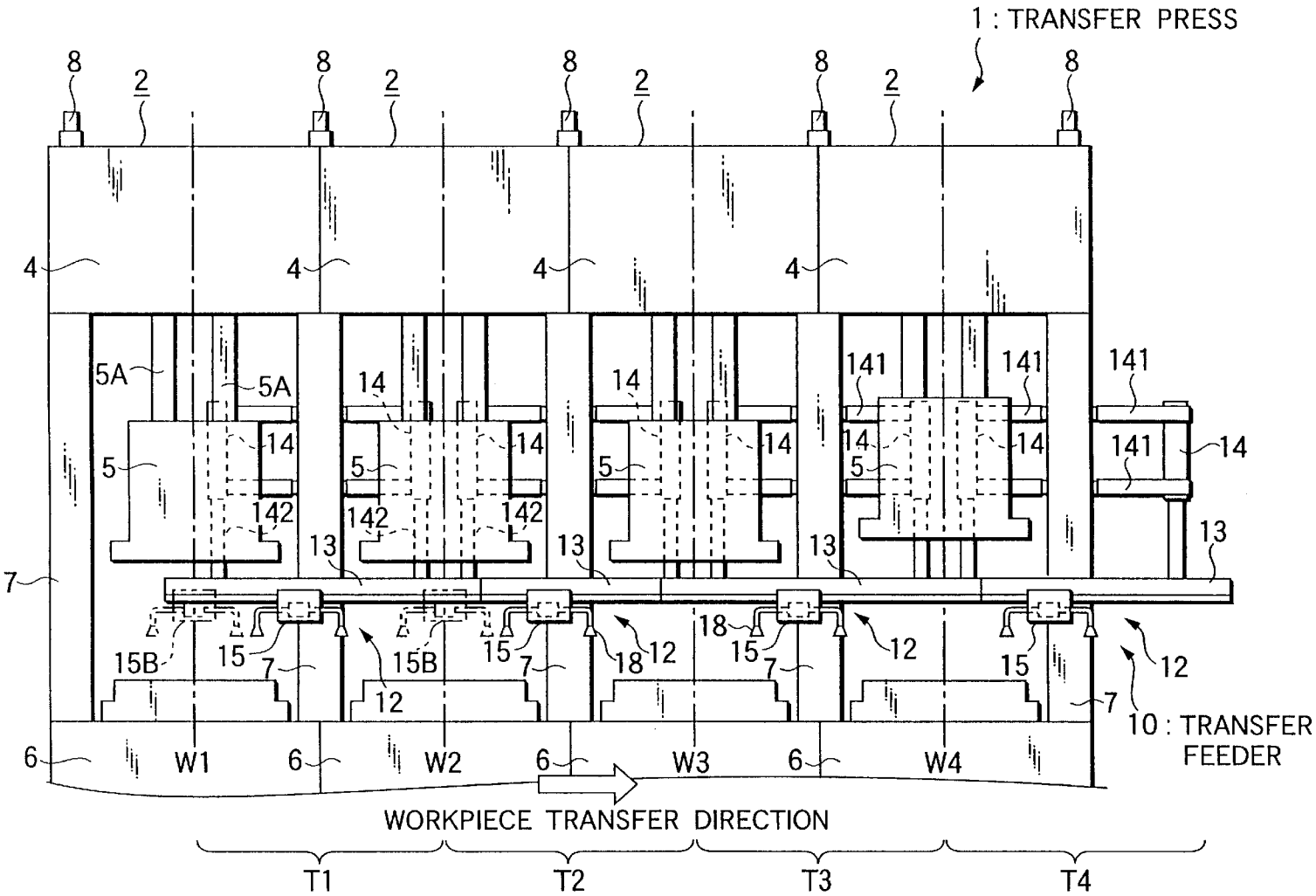
FIG. 3 is a front view showing the transfer press of the first embodiment and another operating configuration of the transfer feeder.
Figure 4:
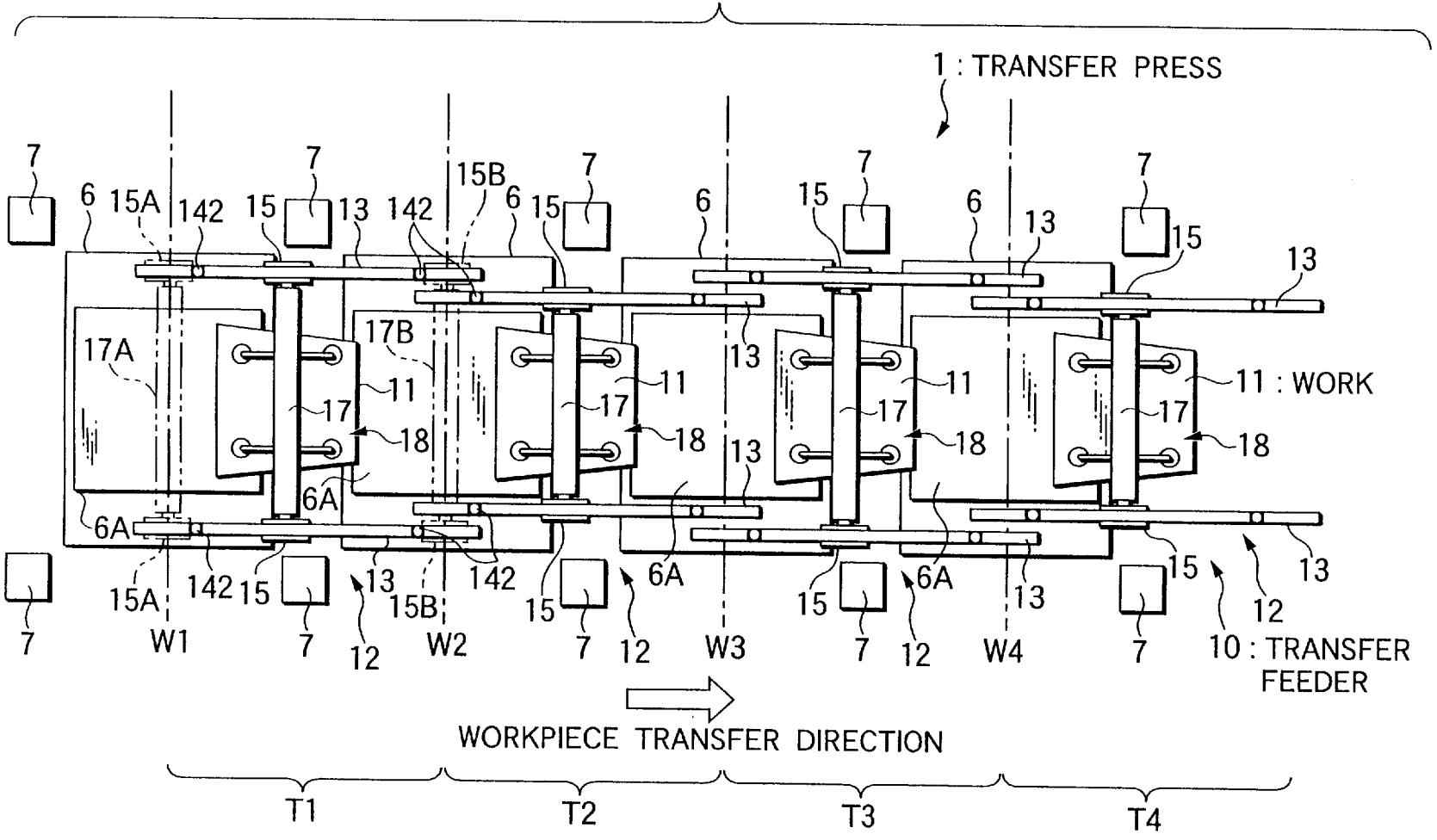
FIG. 4 is a plan view showing the transfer press of the first embodiment.
Figure 5:
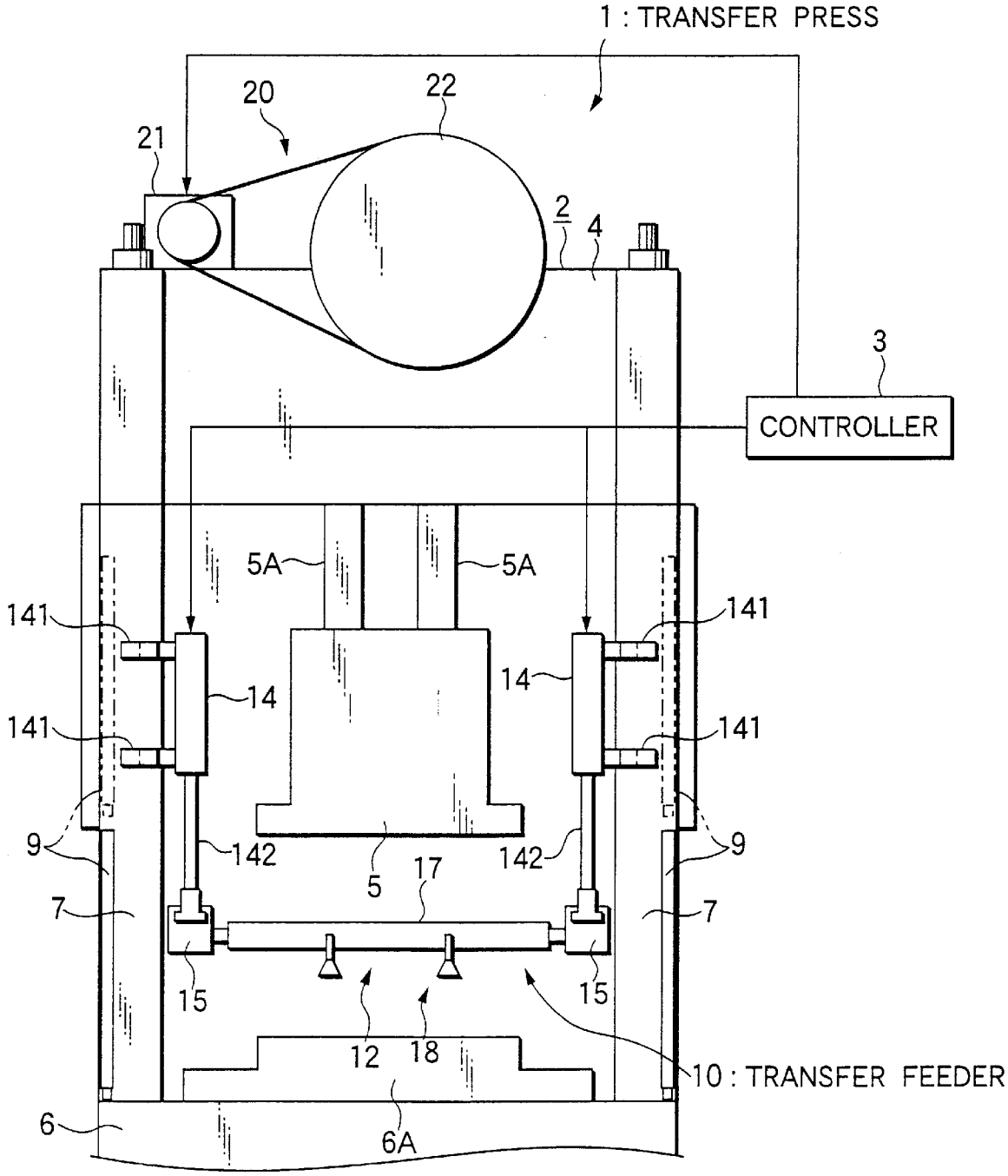
FIG. 5 is a side elevational view showing the transfer press of the first embodiment.
Figure 6:
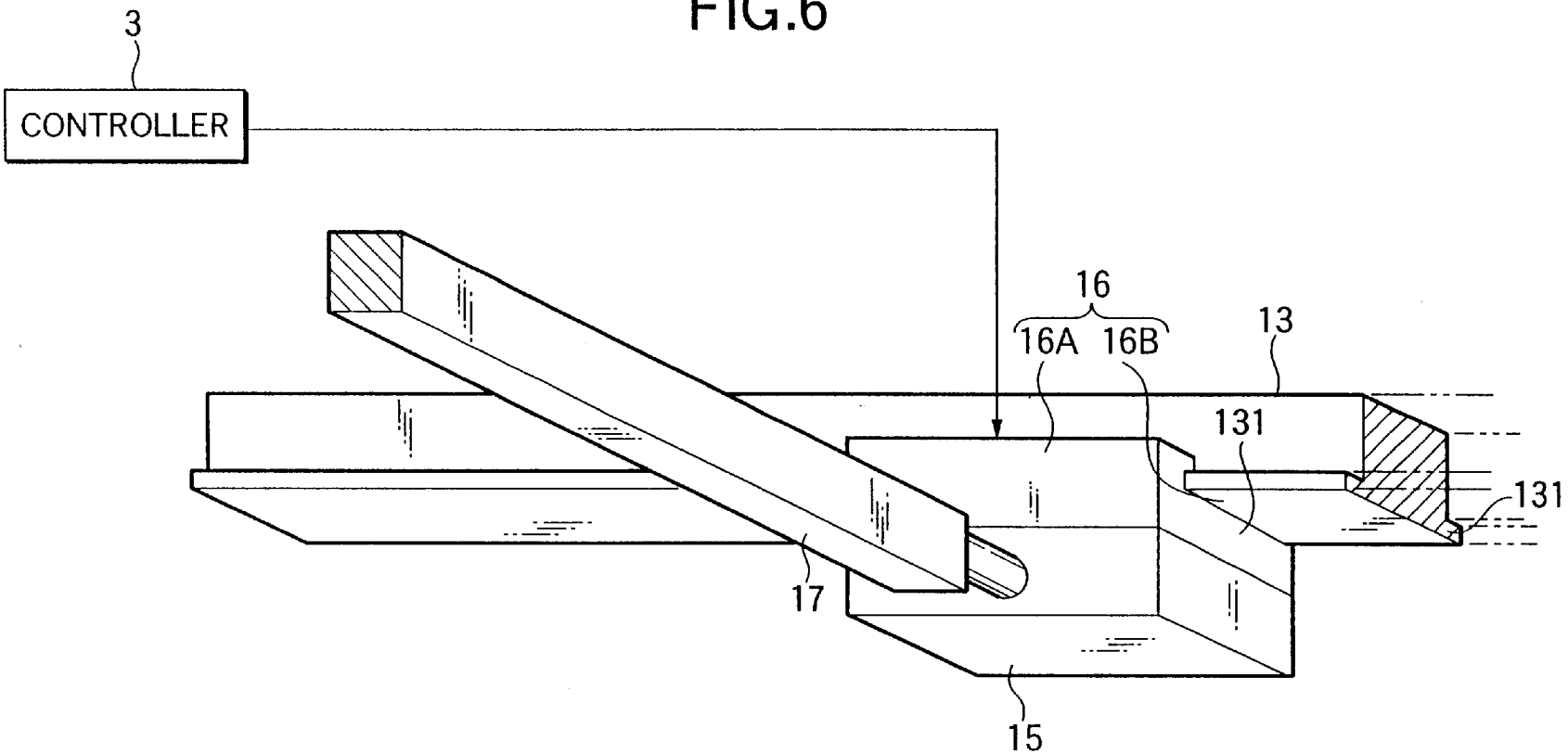
FIG. 6 is a perspective view showing an essential part of the transfer feeder of the first embodiment as viewed from below.

FIG. 1 is a general, perspective view schematically showing a transfer press 1 according to the first embodiment of the invention. FIGS. 2 and 3 are front views showing the transfer press 1 and different operating conditions of a transfer feeder. FIGS. 4 and 5 are a plan view and a side view showing the transfer press 1. FIG. 6 is a perspective view of an essential part of the transfer feeder as viewed from below.

First, the transfer press 1 will be described below in detail.

In FIGS. 1 to 5, the transfer press 1 comprises a plurality (four in this embodiment) of modularized press units 2 arranged in a workpiece transfer direction, and is provided with working stations W1 to W4, which correspond to the respective press units 2.

Mounted on the transfer press 1 are a stacker device for workpiece feeding (not shown) and a transfer feeder 10 described later as well as a controller 3 (FIG. 1) as control means composed of a control panel and an operating panel. In such transfer press 1, a workpiece 11 is transferred toward a right side from a left side in the drawings (an upstream side in the left side and a downstream side in the right side in the drawings).

The respective press units 2 constituting the transfer press 1 comprises a set composed of a crown 4, in which a drive force transmitting mechanism such as a crank mechanism, an eccentric mechanism or a crank mechanism is housed, a slide 5 connected to the drive force transmitting mechanism in the crown 4 and mounting thereon an upper mold, and a bed 6, in which a moving bolster 6A mounting thereon a lower mold can be received. However, an ordinary bolster fixed to the bed 6 is in some cases used instead of the moving bolster 6A. Also, illustration of metallic molds is omitted in the respective figures.

Two uprights 7 common to the respective press units 2 are provided upright between adjacent press units 2 to be opposed to each other in a direction perpendicular to the workpiece transfer direction as viewed in a plan view. Tie rods 8 extend vertically through the uprights 7, and are used to connect together the crown 4, bed 6 and the uprights 7 in a press unit 2. Adjacent press units 2 are connected to each other by clamping of tie bolts (not shown) in the workpiece transfer direction. Vertically openable, protective fences 9 (FIG. 5) are provided between the uprights 7.

In addition, these uprights 7 and tie rods 8 are provided two to upstream and downstream ends in the workpiece transfer direction as shown in the figure.

As shown in FIGS. 1 and 5, the slide 5 in the respective press units 2 is driven by a slide drive 20 (not shown in FIGS. 2 and 3) provided every press unit 2.

The slide drive 20 is composed of a main motor 21 as a drive source, a flywheel 22 rotated by the main motor 21, a clutch (not shown) for intermittently transmitting rotational energy of the flywheel 22 to the drive force transmitting mechanism in the crown 4, and a brake 23 for stopping movements (slide motion) of the slide 5, the slide drive being arranged on, for example, an upper portion of the crown 4.

These main motor 21, flywheel 22, clutch, and the brake 23 are considerably small in size as compared with the prior arrangement, in which all slides are driven together and a lengthy, large-scale transfer bars are driven, and smaller in drive force consumption even when a lift shaft servomotor 14 and a linear motor 16 are added to them.

The controller 3 serves to control slide drives 20 of the press units 2 for driving of the slides 5, and comprises W1 to W4 control means 3A to 3D for individually controlling the slide drive 20 every press unit 2, and overall control means 3E for controlling these W1 to W4 control means 3A to 3D overall, the controller being fabricated by the control technique making use of a computer.

Each of W1 to W4 control means 3A to 3D has the function equivalent to that of control means in general single presses, and controls the slide drive 20 of a corresponding one of the working stations W1 to W4 irrespective of other slide drives 20 to drive the slide 5 singly.

The overall control means 3E functions to controllingly link two or more control means (3A to 3D) optionally selected from W1 to W4 control means 3A to 3D together, and controls the slide drives 20 of the working stations (W1 to W4) corresponding to the selected control means (3A to 3D) to synchronously drive the respective slides 5 without phase difference or under different conditions.

Accordingly, such controller 3 enables <1> control for synchronously driving the slides 5 in all the working stations W1 to W4 without phase difference (synchronous drive mode without phase difference), <2> control for optionally setting drive conditions of the slides 5 in all the working stations W1 to W4 to synchronously drive the slides together (synchronous drive mode under different conditions), <3> control for singly driving the slides 5 in all the working stations W1 to W4 (single drive mode), and <4> control (multi-drive mode), in which synchronous drive without phase difference, synchronous drive under different conditions and single drive are combined optionally, and the W1 to W4 control means 3A to 3D enable maintaining the slides 5 in stoppage when the slides 5 are driven singly.

And in the controller 3, any one of the drive modes is selected by way of the operating panel or the like to start up the control means (3A to 3E) conformed to a selected drive mode to control the operation of the transfer press 1. Also, the controller 3 is provided with T1 to T4 control means 3F to 3I for controlling the transfer feeder 10.

The transfer feeder 10 will be described below in detail.

The transfer feeder 10 transfers workpieces 11, which having been worked in the respective working stations W1 to W4, to a downstream side in transfer areas T1 to T4 set between centers of the respective working stations W1 to W4, the transfer feeder being composed of four feed units 12 arranged in the respective transfer areas T1 to T4.

The feed units 12 comprise a pair of lift beams 13 (correspond to conventional transfer bars but the transfer bars themselves in the invention do not have the transfer function but only the lift function, and so they will be called hereinbelow "lift beams") arranged in parallel along the workpiece transfer direction and spaced horizontally from each other not to interfere with slide motions, lift shaft servomotors 14 for driving the lift beams 13 vertically, carriers 15 mounted on the respective lift beams 13, linear motors 16 (FIG. 6) for moving the carriers 15 lengthwise of the lift beams 13, a cross bar 17 bridging transversely between the carriers 15, and a vacuum cup device 18 mounted on the cross bar 17, the vacuum cup device 18 being constructed to attract a workpiece 11 at several (four in the embodiment) locations.

The lift beams 13 have a small length corresponding to about a half of a conventional transfer bar so that proximate portions thereof in the workpiece transfer direction are disposed every one of the respective transfer areas T1 to T4.

Concretely, the lift beams 13 are somewhat longer than a length (length in the workpiece transfer direction) of the transfer areas T1 to T4, and disposed such that portions having substantially the same length extend beyond the transfer areas T1 to T4 toward upstream and downstream sides.

Also, as shown in FIG. 4, the lift beams 13 in the transfer areas T2 and T4 are disposed inside the lift beams 13 in the transfer areas T1 and T3, so that as viewed in plan view, ends of the lift beams 13 adjacent to each other in the workpiece transfer direction are opposite to one another in positions (shown by alternate long and short dash lines in the figure) corresponding to centers of the working stations W1 to W4 and in a direction (up and down direction in FIG. 4) perpendicular to the workpiece transfer direction.

Provided on undersides of such lift beams 13 are longitudinally continuous, horizontal flange-shaped guides 131 as shown in FIG. 6.

The lift shaft servomotors 14 are supported through support members 141 by the uprights 7, and used to rotate pinions (not shown) whereby vertical rods 142 formed with racks adapted to mesh with the pinions are moved up and down to move the lift beams 13 vertically. Timing of start-up and rotational speed of the servomotors 14 are preset with the use of a suitable input means provided on the operating panel or the like and controlled by the controller 3.

In addition, while one lift beam 13 is moved vertically by two servomotors 14, one or three servomotors 14 may serve provided that the arrangement is able to move the lift beam 13 vertically in a natural and stable position, and the number of servomotors 14 and a connecting structure of the servomotors and the lift beams 13 may be determined optionally when put to practical use.

The linear motors 16 comprise a carrier-side constituent portion 16A and a lift beam-side constituent portion 16B as shown in FIG. 6. The carrier-side constituent portion 16A engages with and moves on the guide 131 of the lift beam 13, timing and speed of movement thereof being preset and controlled by the controller 3. With such linear motors 16, a primary coil is provided on the carrier-side constituent portion 16A and a secondary conductor or secondary permanent magnet is provided on the lift beam-side constituent portion 16B on the underside of the lift beam 13 to be opposite to the primary coil.

In addition, the primary coil may be provided on the lift beam-side constituent portion 16B and the secondary conductor or secondary permanent magnet may be provided on the carrier-side constituent portion 16A to be opposite to the primary coil.

The carrier 15 is mounted integrally on the underside of the carrier-side constituent portion 16A of the linear motor 16 to move together with the carrier-side constituent portion 16A.

The cross bar 17 and the vacuum cup device 18 mounted thereon are the same as those used for conventional transfer feeders and have a suitable rigidity and forces (attracting) for surely holding a workpiece.

Referring now to FIG. 1, the T1 to T4 control means 3F to 3I on the controller 3 function to control the servomotors 14 and the linear motors 16 in the transfer areas T1 to T4 and to individually drive the lift beams 13 and the carriers 15 every one of the respective transfer areas T1 to T4 under drive conditions composed of a predetermined timing of drive, driving speed, drive amount (quantity of lift, quantity of feed).

And the T1 to T4 control means 3F to 3I also provide for mutual control between the servomotors 14 and the linear motors 16 every one of the respective transfer areas T1 to T4 so that movements of the lift beams 13 are linked with movements of the carriers 15.

Also, the overall control means 3E of the controller 3 functions to controllingly link two or more control means (3F to 3I) optionally selected from the T1 to T4 control means 3F to 3I together, and controls the servomotors 14 and the linear motors 16 corresponding to the selected control means (3F to 3I) to synchronously drive the respective servomotors 14 and the linear motors 16 between the transfer areas T1 to T4 without phase difference or under optionally selected drive conditions.

Further, the overall control means 3E can controllingly link the W1 to W4 control means 3A to 3D and the T1 to T4 control means 3F to 3I together, and links slide motions in the working stations W1 to W4 with movements of the lift beams 13 and the carriers 15 in the transfer areas T1 to T4.

Accordingly, such controller 3 enables <1> control for synchronously driving the lift beams 13 and the carriers 15 in all the transfer areas T1 to T4 without phase difference and under the same drive conditions such as timing of drive, driving speed, drive amount (synchronous drive mode without phase difference), <2> control for optionally setting drive conditions of the lift beams 13 and the carriers 15 in all the transfer areas T1 to T4 to synchronously drive them together (synchronous drive mode under different conditions), <3> control for optionally setting drive conditions and singly driving all the lift beams 13 and the carriers 15 every one of the transfer areas T1 to T4 (single drive mode), and <4> control (multi-drive mode), in which synchronous drive without phase difference, synchronous drive under different conditions and single drive are combined optionally, and when single drive is effected by the T1 to T4 control means 3F to 3I, the lift beams 13 and the carriers 15 can be maintained in stoppage state.

And in the controller 3, any one of the drive modes is selected by way of the operating panel or the like to start up the control means (3E to 3I) conformed to a selected drive mode to control the operation of the transfer feeder 10.

Here, an explanation will be given to a typical method of transferring workpieces 11 with the transfer feeder 10 constructed in the above manner.

First, when working in the working station W1 is terminated in the transfer area T1 and the slide 5 turns to rise, the carriers 15 on the lift beams 13 disposed at a predetermined level are moved along the lift beams 13 to reach ends on the side of the working station W1 (refer to the carriers 15A and the cross bar 17A shown by two-dot chain lines in FIGS. 2, 3 and 4), and the vacuum cup device 18 is positioned on a center of the working station W1, in which position the lift beams 13 are lowered to afford attracting the workpiece 11.

Subsequently, the lift beams 13 are raised, the carriers 15 are moved to ends on the side of the working station W2 (refer to the carriers 15B and the cross bar 17B shown by two-dot chain lines in FIG. 4), and the vacuum cup device 18 is positioned on a center of the working station W2, in which position the lift beams 13 are lowered to afford releasing the workpiece 11. Subsequently, before the slide 5 in the working station W2 is fully lowered, that is, before working in the working station W2 is started, the lift beams 13 are raised and the carriers 15 are returned to approximately a center of the transfer area T1 not to interfere with the slide 5 and metallic molds.

Subsequently, when working in the working station W2 is terminated, the lift beams 13 and the carriers 15 in the transfer area T2 are also driven in the same manner as the feed unit 12 in the transfer area T1.

And carrying-in and carrying-out are made in all the transfer areas T1 to T4 by driving the feed units 12 also in the transfer areas T3 and T4 in the same manner, and finally the workpiece is forwarded to a carrying-out device (not shown) from the transfer area T4.

In addition, actually, movements of the carriers 15 are not made in a state, in which the lift beams 13 are standstill, but are made while the lift beams 13 are moved up and down. Thereby, efficient transfer is enabled to increase the working speed.

Typical configurations among the operating configurations of the transfer press 1 and the transfer feeder 10 will be described below together with the drive modes. Operating configuration A (both the transfer press and the transfer feeder are operated in "synchronous drive mode without phase difference")

In this operation, the slides 5, lift beams 13 and the carriers 15 are synchronously driven between all the press units 2 and the feed units 12 without phase difference, and the transfer press 1 and the transfer feeder 10 are operated in the same manner as in the prior art.

More specifically, the slides 5 are synchronously driven without phase difference therebetween in all the working stations W1 to W4 to apply working to the workpieces 11 substantially at the same time. Immediately after working of the workpieces 11 is terminated and the respective slides 5 turns to rise substantially at the same time, the lift beams 13 and the carriers 15 in the transfer feeder 10 are also synchronously driven without phase difference therebetween and at the same driving speed and drive amount in all the transfer areas T1 to T4 to forward the workpieces 11 all together to next steps.

At this time, all the W1 to W4 control means 3A to 3D and the T1 to T4 control means 3F to 3I are started up in the controller 3, and the overall control means 3E controllingly links all these control means 3A to 3D, 3F to 3I together.

Such operating configuration A is implemented by selecting drive modes of both of the transfer press 1 and the transfer feeder 10 as "synchronous drive mode without phase difference" in the operating panel of the controller 3. Operating configuration B (the transfer press: "synchronous drive mode without phase difference", the transfer feeder: "synchronous drive mode under different conditions")

In this operation, the transfer press 1 is operated in the same manner as in the prior art, and the transfer feeder 10 is operated in the same manner as in a transfer device in a tandem press line. The manner in such operating configuration is shown in FIG. 2.

In FIG. 2, the slides 5 in all the working stations W1 to W4 of the transfer press 1 are synchronously driven without phase difference therebetween.

Meanwhile, the lift beams 13 and the carriers 15 in the transfer feeder 10 are synchronously driven at the same driving speed and drive amount in the transfer areas T1, T2. In contrast, carrying-out from the working station W3 is made in the transfer area T3 under the same driving conditions as those in the transfer areas T1, T2, and carrying-in into the working station W4 is made under driving conditions with driving speed and drive amount different from those in the transfer areas T1, T2. Also, carrying-out from the working station W4 is made in the transfer area T4 under driving conditions with driving speed and drive amount different from those in the transfer areas T1, T2, and discharge to a discharge device (not shown) is made under the same driving conditions as those in the transfer areas T1, T2.

With such operating configuration in the transfer areas T1, T2, when working of all the workpieces 11 is terminated substantially at the same time and the slides 5 turns to rise, the lift beams 13 and the carriers 15 are simultaneously driven to begin carrying-out.

However, for example, in the case where the metallic mold in the working station W4 is somewhat larger in size than those in the other working stations W1 to W3, a workpiece 11 in the transfer area T3 is discharged from the working station W3 at the same timing as that in the transfer areas T1, T2. After such discharge, the lift beams 13 and the carriers 15 in the transfer area T3 are once stopped in positions, where there is no interference between the metallic mold and the workpiece 11, or driven at low speed taking account of interference to delay carrying-in of the workpiece 11 into the working station W4 until the slide 5 in the working station W4 becomes adequately high in level.

Meanwhile, the operation in the transfer area T4 is such that until the slide 5 becomes adequately high in level, the lift beams 13 and the carriers 15 are once stopped or driven at low speed so as to avoid interference to delay carrying-out of a workpiece 11 from the working station W4, and after being discharged, the workpiece 11 is carried onto a discharge device (not shown) at the same timing as that in the transfer areas T1, T2.

Thereby, even if the metallic mold in the working station W4 is somewhat large in size, transfer of the workpiece 11 is smoothly performed without interference with the metallic mold.

In addition, after the slides 5 in the transfer areas T3, T4 have become adequately high in level, the lift beams 13 and the carriers 15 may be driven at higher speed in that motion, in which acceleration applied on the vacuum cup devices 18 is restricted, whereby it is possible to complete carrying-in and carrying-out of workpieces 11 in all the transfer areas T1 to T4 substantially at the same time and to instantaneously drive all the slides 5 for subsequent working.

Also, in the case where metallic molds in any one of the remaining working stations as well as in the working station W4 are large in size, transfer of workpieces 11 can be smoothly performed by way of the same control as that described above.

At this time, all the W1 to W4 control means 3A to 3D and the T1 to T4 control means 3F to 3I are also started up in the controller 3, and the overall control means 3E controllingly links all these control means 3A to 3D, 3F to 3I together.

However, the operating panel of the controller 3 is used to select"synchronous drive mode without phase difference" as the drive mode of the transfer press 1, "synchronous drive mode under different conditions" as the drive mode of the transfer feeder 10, and which of the lift beams 13 and the carriers 15 should be made different in drive conditions. Operating configuration C (the transfer press: "synchronous drive mode under different conditions", the transfer feeder: "synchronous drive mode without phase difference")

In this operation, a part or all of the transfer press 1 is operated in the same manner as a tandem press, and the transfer feeder 10 is operated in the same manner as in the prior art. The manner in such operating configuration is shown in FIG. 3.

First, synchronous driving of the respective slides 5 with an optional phase difference, among the configurations of driving under different conditions, will be described.

In FIG. 3, the slide 5 in the working station W4 is synchronously driven an amount of preset phase difference earlier than the slides 5 in the working stations W1 to W3 in the transfer press 1. At this time, the slides 5 in the other working stations W1 to W3 are synchronously driven without phase difference therebetween.

Meanwhile, the transfer feeder 10 is operated such that the lift beams 13 and the carriers 15 in all the transfer areas T1 to T4 are synchronously driven without phase difference and under the same driving condition.

In such operating configuration, the slide 5 in the working station W4 is first lowered, and subsequently the respective slides 5 in the working stations W1 to W3 are lowered all together. Thereafter, when working of the workpieces 11 in the working stations W1 to W3 is terminated and the slides 5 turns to rise, all the lift beams 13 and the carriers 15 are driven all together to begin transfer.

Thereby, in the transfer area T4, the slide 5 in the working station W4 is positioned higher than the slides 5 in the working stations W1 to W3 when the lift beams 13 and the carriers 15 are driven for attraction of a workpiece 11, whereby a workpiece 11 is smoothly carried out without interference with a metallic mold or the like even when working, for example, deep drawing is applied so that the workpiece 11 subjected to working in the working station W4 will have a large height (vertical dimension).

In addition, in the case where the workpiece 11 in any one of the remaining working stations as well as in the working station W4 has a large height, transfer of the workpieces 11 can be smoothly performed by way of the same control as that described above.

Subsequently, stoppage at top dead point every cycle, among the configurations of driving of the respective slides 5 under different conditions, will be described.

For example, it is assumed that deep drawing is effected in the working station W1. It is required in the working station W1 that the slide 5 be driven at low speed so as not to cause crack in a workpiece 11. However, it is required in the other working stations W2 to W4 that the slides 5 be rapidly raised in order to facilitate transfer of workpieces. Also, it is necessary to make cycle time consistent in the both cases. Therefore, after the slides 5 in the working stations W2 to W4 are more rapidly driven than in the working station W1, they are stopped at top dead points to make cycle time consistent with that in the working station W1.

Thereby, mold design is made easy to enhance working accuracy relative to productivity, and reduction in mold service life, due to the enhanced productivity, can be suppressed.

In such operation, the overall control means 3E controllingly links the W1 to W4 control means 3A to 3D and the T1 to T4 control means 3F to 3I together, and the operating panel of the controller 3 is used to select "synchronous drive mode under different conditions" as the drive mode of the transfer press 1, and to select which of the slides 5 should cause phase shift and "synchronous drive mode without phase difference" as the drive mode of the transfer feeder 10. Operating configuration D (both the transfer press and the transfer feeder are operated in "single drive mode")

In this operation, any one slide or slides 5, lift beams 13 and carriers 15 as selected are singly driven, for example, the slides 5, lift beams 13 and the carriers 15 are driven only in the working station W1 and in the transfer area T1, and all the operations in the other working stations W2 to W4 and in the transfer areas T2 to T4 are stopped.

In this configuration, one press unit 2 and one feed unit 12 form a single press (line).

In this case, the same working as in a single press is performed in the working station W1 as driven, and, for example, the working station W2 on a downstream side is used as a station where workpieces 11 having been subjected to working are stacked. Then drive conditions for the lift beams 13 and the carriers 15 are set so that interference between the workpieces 11 and metallic molds is avoided and the workpieces 11 having been subjected to working can be stacked.

And the main motors 21 of the slide drives 20 themselves are stopped in the press units 2 in the working stations W2 to W4 as stopped, and the flywheels 22 are also not rotated, which achieves energy saving.

In addition, as slides 5 to be driven one or two or more slides 5 may be driven individually. Also, in the case where a plurality of slides are to be driven, the adjacent slides 5 may be driven or the spaced slides 5 may be driven.

Further, the transfer feeder 10 may be operated such that the lift beams 13 and the carriers 15 in the transfer areas T1 to T4 in positions corresponding to the slides 5 to be driven are driven. For example, in the case of driving only one slide 5, the lift beams 13 and the carriers 15 may be driven in all the transfer areas T1 to T4, so that after a workpiece 11 is carried into the transfer press 1 from a stacking device disposed on a most upstream side and subjected to working at an optional location, the workpiece 11 can be discharged by a carrying-out device disposed on a most downstream side.

In the controller 3, the W1, T1 control means 3A, 3F corresponding to the working station W1 and the transfer area T1 are started up and the overall control means 3E is started up to link the former control means, but the other W2 to W4, T2 to T4 control means 3B to 3D, 3G to 3I are not started up.

The operating panel of the controller 3 is used to select "single drive mode" as the drive mode of both the transfer press 1 and the transfer feeder 10, and which of the slides 5, the lift beams 13 and the carriers 15 should be driven.

The present embodiment provides the following effects:

(1) The transfer press 1 provides the main motors 21 every press unit 2, and so the main motors 21 can be made markedly small in size as compared with a prior main motor 21, which is used to drive all slides 5. Also, by virtue of the main motors 21 being made small in size, the flywheel 22, clutch and the brake 23, which constitute the slide drive 20, can be small in size as compared with the prior art.

Accordingly, these parts constituting the slide drive 20 are further usable for various purposes, and so can be purchased quickly and inexpensively. Further, spare parts for such parts can be easily stocked in factories or the like, and production can be prevented from being crippled because rapid countermeasures are taken without stopping the production line over a long term in the case where replacement is needed due to failure or the like.

(2) Also, since the transfer press 1 can be operated in many configurations such as the operating configurations A to D by controlling the main motors 21 of the respective press units 2 with the respective control means 3A to 3I of the controller 3, it can accommodate various workings such that it serves partly as a tandem press to accommodate deep drawing in addition to conventional transfer working and functions as a single press.

(3) The lift beams 13 and the carriers 15 in the transfer areas T1 to T4 can be driven under optional drive conditions by using the respective control means 3A to 3I of the controller 3 to control not only the respective slides 5 in the transfer press 1 but also the servomotors 14 and the linear motors 16 in the transfer feeder 10. Accordingly, the lift beams 13 and the carriers 15 can be always driven in a state of avoiding interference with metallic molds, by virtue of being controlled in accordance with the metallic molds used in the working stations W1 to W4, so that conventional restrictions on metallic molds are mitigated to enable providing great freedom in mold design.

(4) Also, owing to mitigation of restrictions on metallic molds, even metallic molds used in conventional tandem presses and single presses can be applied for other uses without substantial reconstruction, and so labor and cost for fabricating new metallic molds can be reduced.

(5) The transfer press 1 and the transfer feeder 10 can be operated in a conventional manner by synchronously driving the slides 5, lift beams 13 and the carriers 15 in all in the working stations W1 to W4 and the transfer areas T1 to T4 without phase difference, as in the above-mentioned operating configuration A.

(6) Even in the case of using somewhat large-sized metallic molds, carrying-in and carrying-out of workpieces 11 can be terminated in the transfer areas T1 to T4 at the same timing to keep transfer efficiency favorable when the lift beams 13 and the carriers 15 are shifted in timings of start-up and stoppage and driven at high speed in motions, by which acceleration applied on the vacuum cup devices 18 is suppressed, as described in the operating configuration B.

(7) When the slide or slides 5 are driven with advanced phase as in the operating configuration C, working, such as deep drawing or the like, having been conventionally difficult in press units 2 with advanced phase can be realized and workpieces 11 formed thereby can be smoothly carried out even in the case where metallic molds of the same size essential in the transfer press 1 are used and the lift beams 13 and the carriers 15 are driven by original movements of the transfer feeder 10 (synchronously driven at the same driving speed and drive amount and without phase difference). Further, stoppage at top dead points every cycle makes it possible to surely perform working, such as deep drawing or the like, while ensuring productivity.

(8) By performing single driving of all the slides 5, the lift beams 13 and the carriers 15 as in the operating configuration D, the respective press units 2 and the feed units 12 can be handled as a single press machine and a single feed device, so that even when transfer working is not performed, it is possible to surely accommodate various working provided that metallic molds for a single press machine are set for working and the lift beams 13 and the carriers 15 are driven under drive conditions conformed to sizes of the metallic molds.

(9) Since the transfer feeder 10 adopts shorter lift beams 13 than and in place of conventional, lengthy, large-scaled transfer bars, the small-sized servomotors 14 for moving the lift beams 13 up and down and the linear motors 16 moving along the lift beams 13 suffice to be driven to transfer workpieces 11, so that all the servomotors 14 and the linear motors 16 combined can reduce power consumption markedly and promote energy saving as compared with the case where conventional transfer bars are driven by a main large motor and a large servomotor.

(10) Since all the main motors 21 can also be made small in size, the above-mentioned servomotors 14 and the linear motors 16 combined can make power consumption markedly smaller than in the prior art, which can promote energy saving further.

(11) Since adjacent portions in the workpiece transfer direction are provided every one of the respective working stations W1 to W4, the lift beams 13 are small in length every one of the respective transfer areas T1 to T4, so that the more small-sized and lightweight the lift beams 13 are, the further the servomotors 14 can be made small-sized.

Since the magnitudes and number of the lift beams 13, servomotor 14 rods 142, carriers 15, linear motors 16 and the vacuum cup device 18 except the cross bar 17 are common to the respective feed units 12, kinds of members can be reduced to facilitate manufacture of the respective feed units 12.

Also, since the transfer feeder 10 is composed of the feed units 12 in the respective transfer areas T1 to T4, optimum feed motions can be created every one of the transfer areas T1 to T4 to make freedom in mold design considerably great, thus enabling facilitating formation of metallic molds. Further, since it suffices to take account of adjacent transfer areas T1 to T4 when feed motions are to be created, acceleration generated on the lift beams 13 can be made to the minimum and the lift beams 13 are made lightweight, which makes it possible for the transfer feeder 10 to surely follow high speed operation of the transfer press 1.

(12) Since adjacent ends of the lift beams 13 along the workpiece transfer direction face each other in a direction perpendicular to the workpiece transfer direction as viewed in plan view in adjacent transfer areas T1 to T4, the vacuum cup devices 18 on upstream and downstream sides can be made together to get onto central positions of the working stations W1 to W4 when the carriers 15 on the respective lift beams 13 are alternately caused to move toward the facing areas. Accordingly, workpieces 11 are mounted and dismounted in the above positions so that transfer can be surely implemented without any special offset devices.

[Second Embodiment]

An explanation will be given to a transfer feeder 10 according to a second embodiment of the invention with reference to FIGS. 7, 8 and 9.

Figure 7:
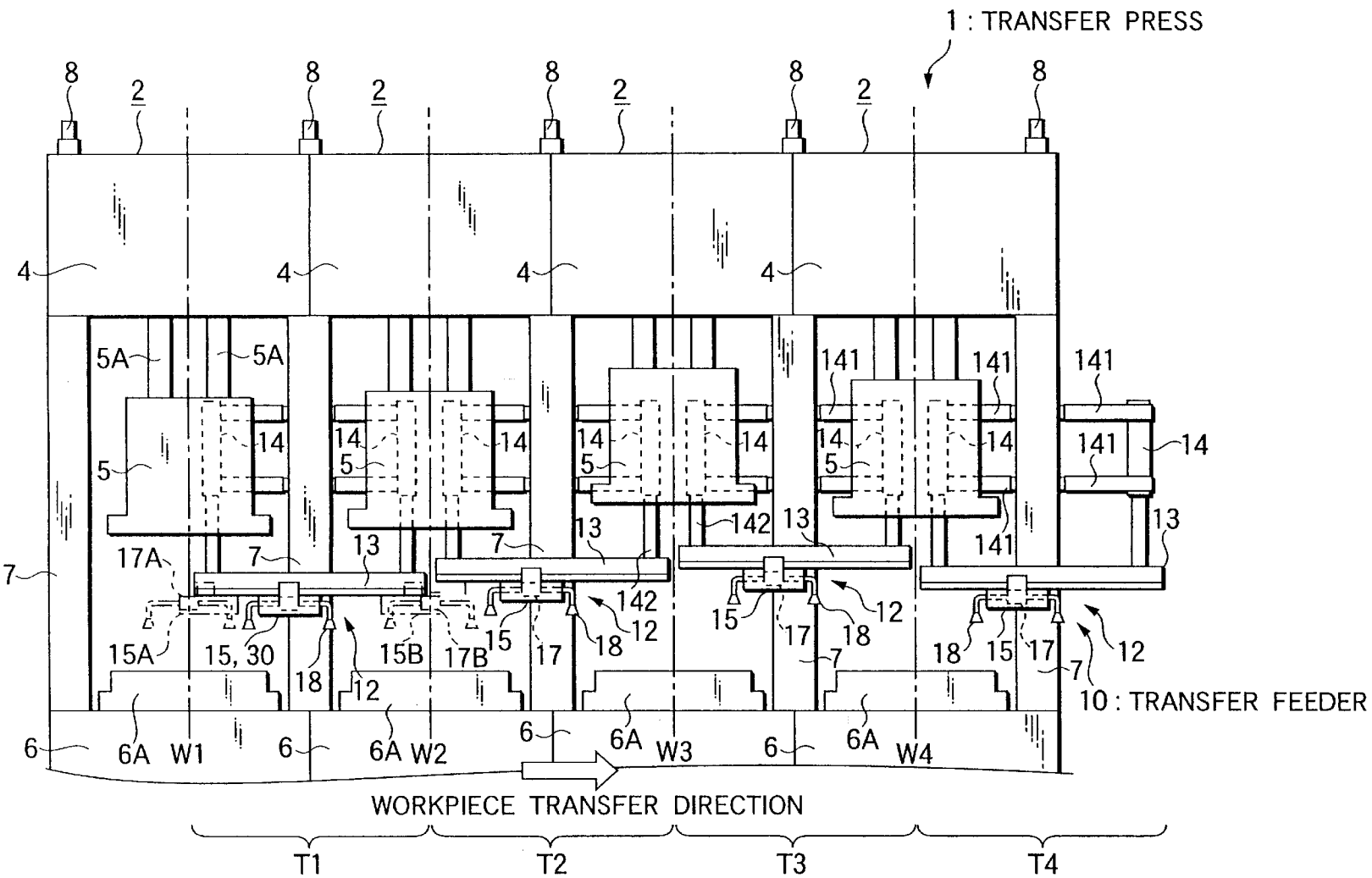
FIG. 7 is a front view showing a transfer press according to a second embodiment of the invention.
Figure 8:
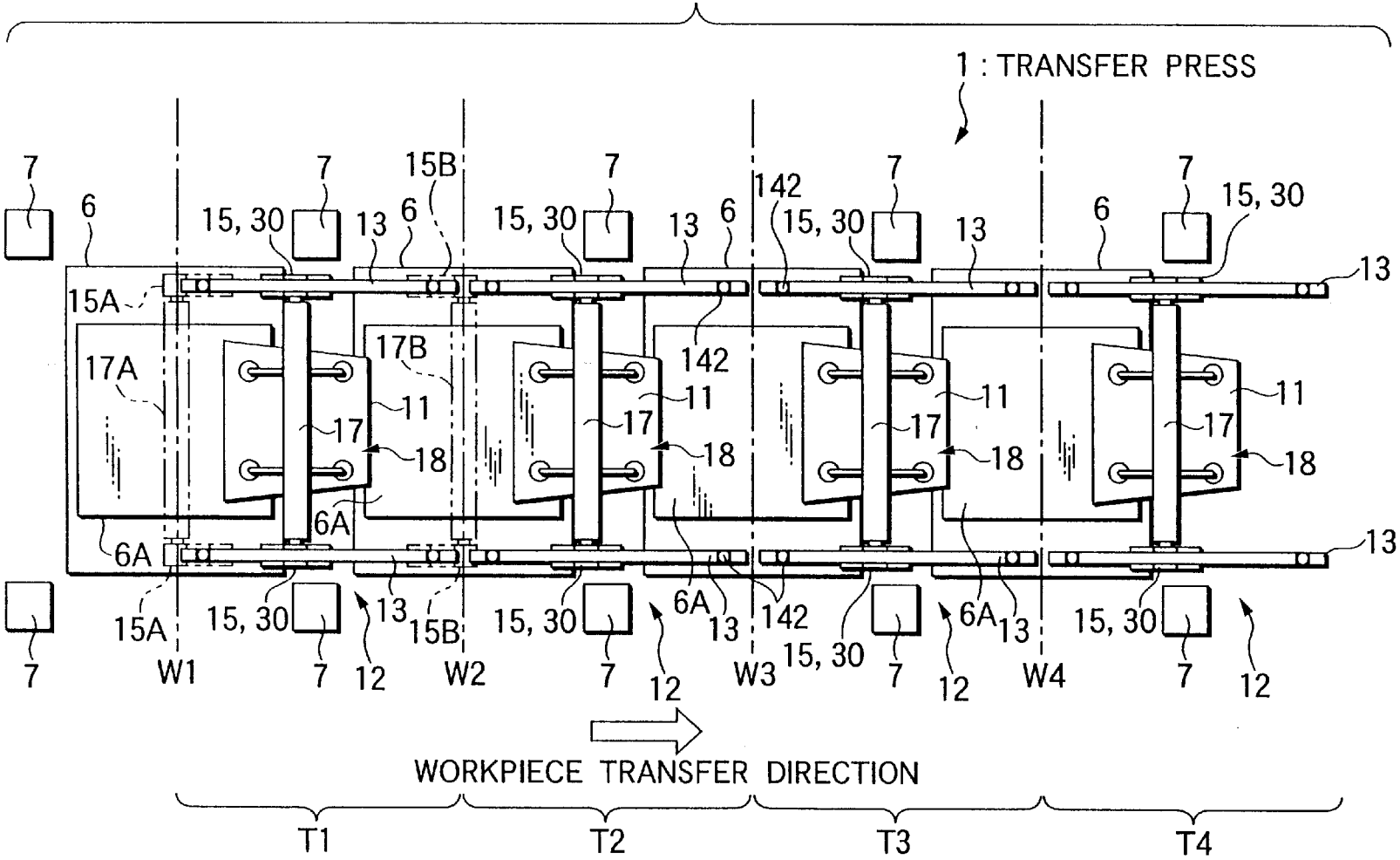
FIG. 8 is a plan view showing the transfer press of the second embodiment.

In FIGS. 7 and 8, lift beams 13 used in the transfer feeder 10 of the embodiment have a somewhat smaller length than that of transfer areas T1 to T4 set at equal pitch (length in a workpiece transfer direction). Also, as shown in FIG. 8, adjacent ends of the lift beams 13 along the workpiece transfer direction as viewed in plan view are positioned to correspond to centers of working stations W1 to W4 and to face each other in the workpiece transfer direction (right and left direction in FIG. 4) in spaced relationship to be disposed on straight lines through the respective transfer areas T1 to T4.

Figure 9:
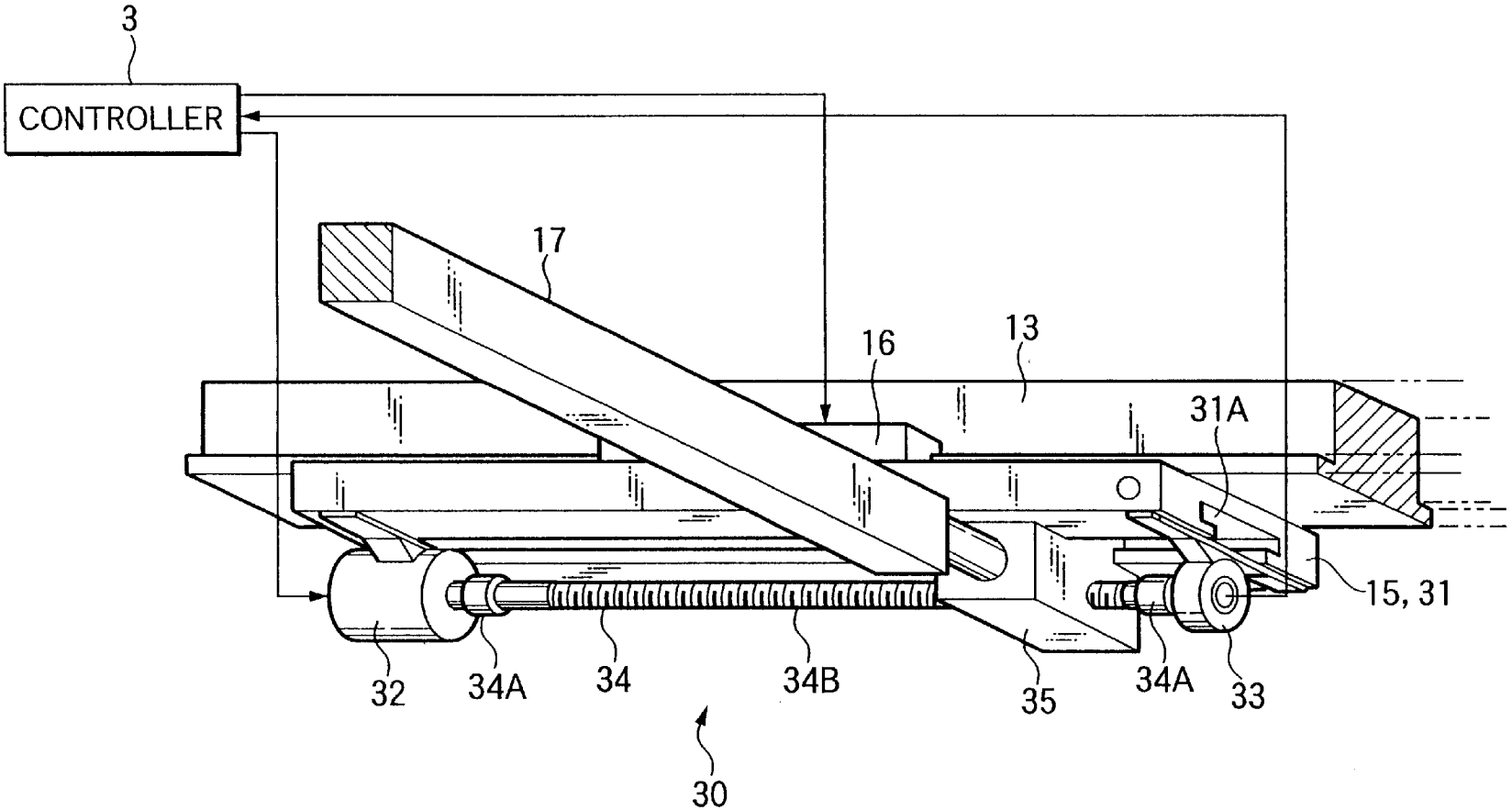
FIG. 9 is a perspective view showing an essential part of the transfer feeder used in the second embodiment as viewed from below.

In FIG. 9, carrier type offset devices 30 are provided on carriers 15 in the present embodiment.

The carrier type offset devices 30 also serve as the carriers 15, and comprise a base plate 31 having a predetermined length and provided with a guide groove 31A along the workpiece transfer direction, a motor 32 provided on an underside of one lengthwise end of the base plate 31, an encoder 33 provided on an underside of the other lengthwise end of the base plate 31, a shaft 34 connected at one end thereof to the motor 32 through a coupling 34A and having the other end thereof supported by the encoder 33 through the coupling 34A, and a movable block 35 adapted to thread on male threads 34B formed on an outer surface of the shaft 34 and fitted into the guide groove 31A of the base plate 31, to which movable block 35 an end of the cross bar 17 is connected.

In such carrier type offset devices 30, the motor 32 drives the shaft 34 while the carriers 15 are traveling, so that the movable block 35 threaded on the shaft is caused to slide along the guide groove 31A.

More specifically, in the respective lift beams 13, when the carriers 15 are positioned at an upstream side end in the workpiece transfer direction, the movable blocks 35 are also moved toward the upstream side (refer to the carriers 15A and the cross bar 17A shown by two-dot chain lines in FIGS. 7 and 8), and the vacuum cup devices 18 mounted on the cross bars 17 are moved to centers of the working stations W1 to W4.

On the other hand, when the carriers 15 are positioned at a downstream side end, the movable blocks 35 are also moved toward the downstream side (refer to the carriers 15B and the cross bar 17B shown by two-dot chain lines in FIGS. 7 and 8), and the vacuum cup devices 18 mounted on the cross bars 17 are moved to centers of the working stations W2 to W4 (a suitable position on a carrying-out device (not shown) in the transfer area T4).

Thereby, the vacuum cup devices 18 are made offset in the workpiece transfer direction, and workpieces 11 are mounted and dismounted at the centers of the working stations W1 to W4 to be surely transferred.

In addition, control of offset is implemented by virtue of the controller 3 controlling rotational frequency of the motors 32 on the basis of outputs of the encoders 33.

Then an explanation will be given to operating configurations of a transfer press 1 and the transfer feeder 10 in the present embodiment. Operating configuration E (both the transfer press and the transfer feeder are operated in "synchronous drive mode under different conditions")

In this operating configuration, the transfer press 1 and the transfer feeder 10 in combination are caused to function in the same manner as in a tandem press line, the manner of this operation being shown in FIG. 7.

In such operation, the lift beams 13 and the carriers 15 are driven under different drive conditions in accordance with mold sizes in the working stations W1 to W4 and vertical dimensions of workpieces 11 after working). And these drive conditions are set so that taking account of relative positions of the slides 5, interference with metallic molds is eliminated and useless movements are not generated.

At this time, all the W1 to W4 control means 3A to 3D and the T1 to T4 control means 3F to 3I are started up in the controller 3, and the overall control means 3E controllingly links all these control means 3A to 3D, 3F to 3I together.

The operating panel of the controller 3 is used to select "synchronous drive mode under different conditions" as the respective drive modes of the transfer press 1 and the transfer feeder 10.

In addition, while only the operating configuration E has been explained in the present embodiment, the operating configurations A to D in the first embodiment can be of course realized by suitably selecting a drive mode. The present embodiment provides the following effects:

(13) Since the slides 5 are synchronously driven under different conditions and the lift beams 13 and the carriers 15 are driven under optional drive conditions in the present embodiment, the operating configuration E can be implemented, so that the transfer press 1 and the transfer feeder 10 in combination can be caused to function in the same manner as in a tandem press line.

(14) Also, since selection of drive mode makes it possible to implement the operating configurations A to D as in the first embodiment, one transfer press 1 and one transfer feeder 10 enable realizing the original function of a transfer press, the function of a tandem press line and the function of an independent press line, so that it is possible to accommodate various workings.

(15) Since the transfer feeder 10 is constructed such that the lift beams 13 are disposed linearly along the workpiece transfer direction, cross bars having a single kind of length suffice in the present embodiment while the cross bars 17 having two kinds of lengths are necessary in the first embodiment. Thus all the feed units 12 can be made the same in constituent parts, which can dissolve complexity in manufacture.

(16) Also, since the lift beams 13 are disposed on straight lines, widthwise spaces of the transfer areas T1 to T4 interposed between pairs of the lift beams 13 can be made larger than those in the first embodiment, so that there is produced margin between the lift beams 13 and metallic molds to facilitate mold design further.

(17) Further, since the carriers 15 mount thereon the carrier type offset devices 30, workpieces 11 can be mounted and dismounted at centers of the working stations W1 to W4 for sure transfer by making the vacuum cup devices 18 offset even if adjacent ends of the lift beams 13 in adjacent transfer areas T1 to T4 are opposed to each other in the workpiece transfer direction.

[Third Embodiment]

Figure 10:
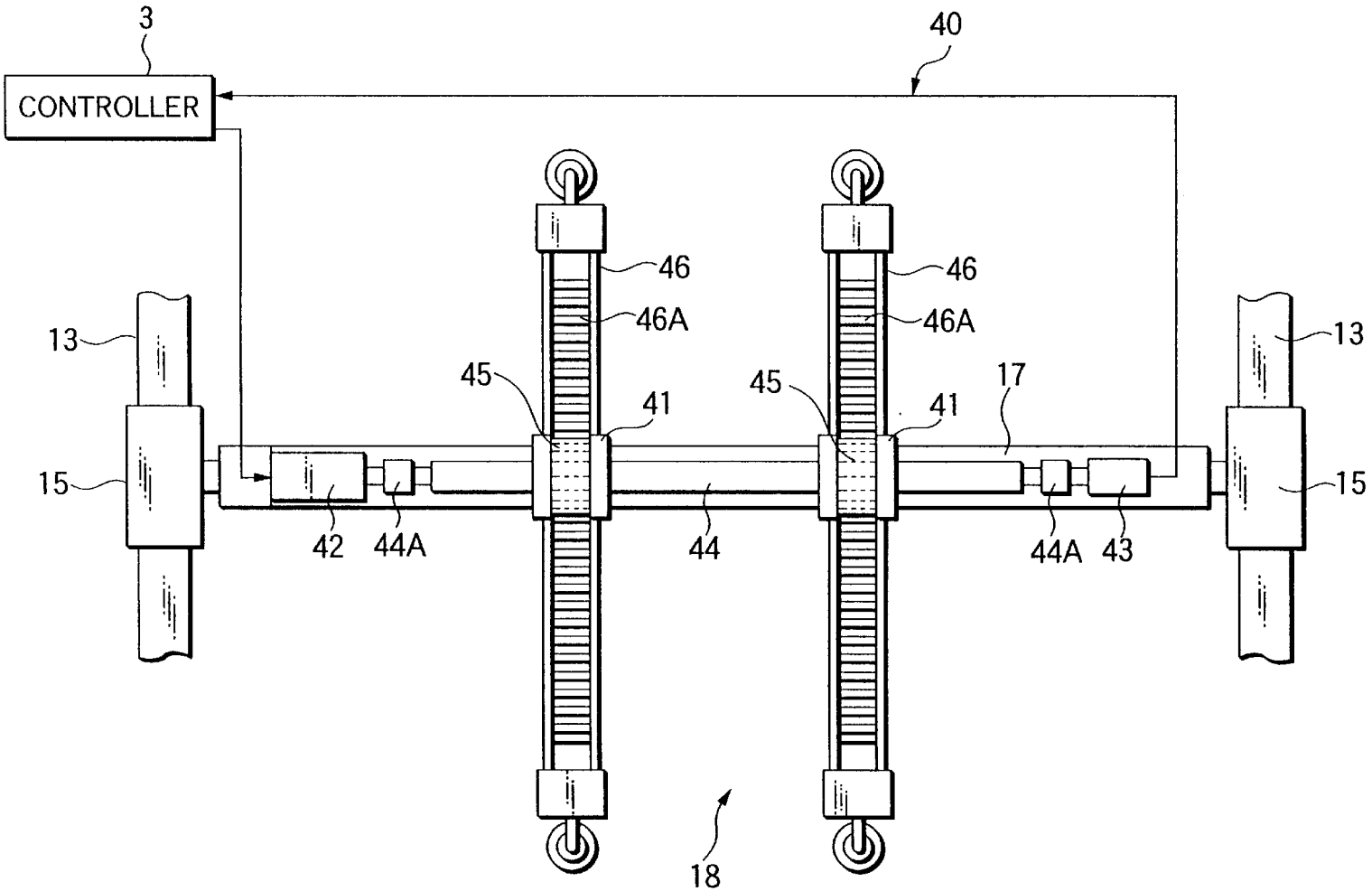
FIG. 10 is a plan view showing an offset device used in a third embodiment.
Figure 11:
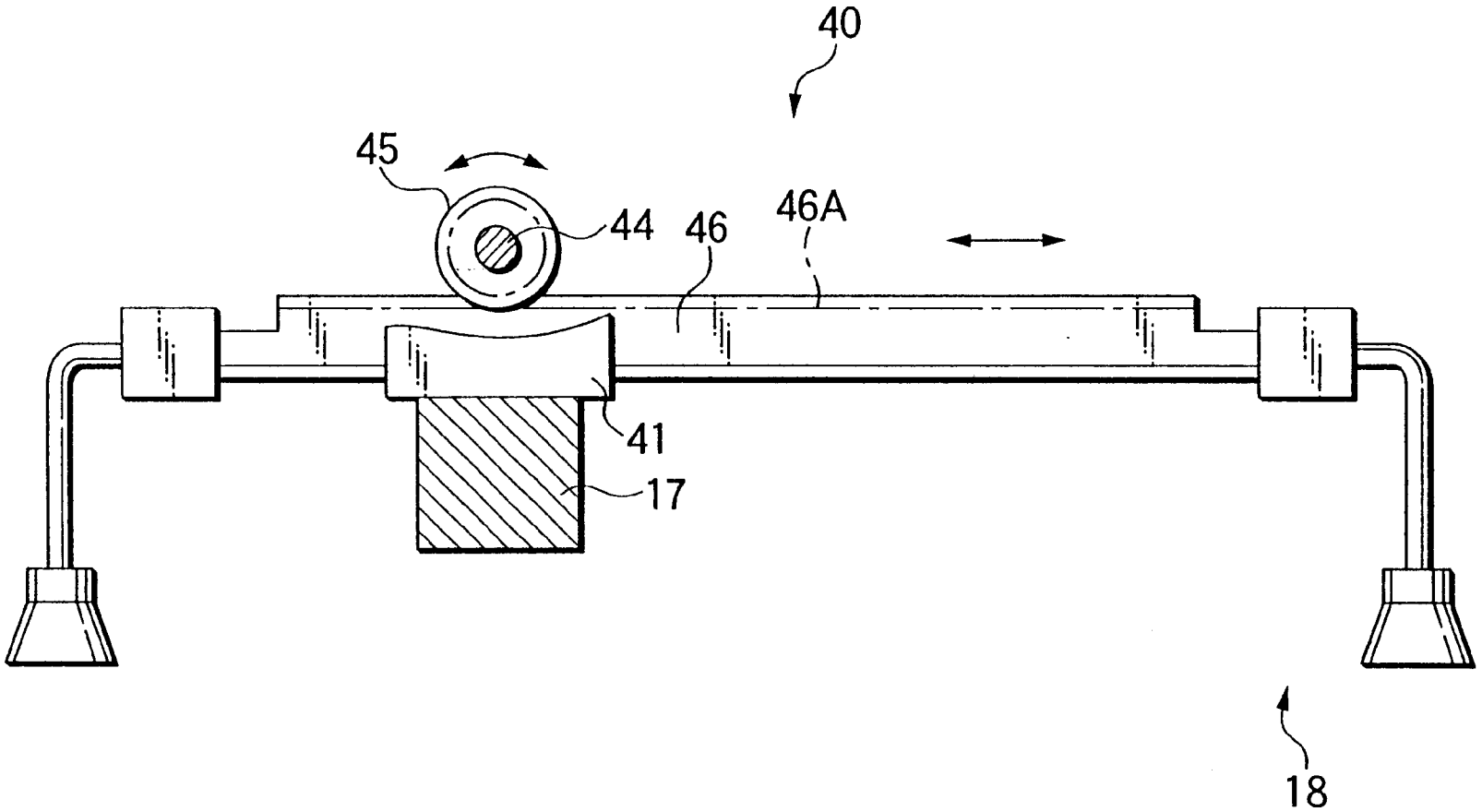
FIG. 11 is a side elevational view showing the offset device of the third embodiment.

FIGS. 10 and 11 shown another embodiment of offset devices.

These devices are constituted by crossover type offset devices 40 provided on the cross bars 17, and comprise a pair of guide members 41 fixed on the cross bar 17 with a spacing in a longitudinal direction thereof, a motor 42 provided on one end side of the cross bar 17, an encoder 43 provided on the other end side of the cross bar, a shaft 44 connected at one end thereof to the motor 42 through a coupling 44A and having the other end thereof supported on the encoder 43 through a coupling 44A, the shaft being rotatably supported by the guide members 41, pinions 45 provided corresponding to the respective guide members 41 and adapted to rotate together with the shaft 44, and movable bars 46 inserted between the pinion 45 and the guide members 41 and formed on upper surfaces thereof with a rack 46A, which mesh with the pinion 45, and sections of the vacuum cup device 18 are mounted on both lengthwise (workpiece transfer direction) ends of the movable bars 46.

With such crossover type offset device 40, the motor 42 on the cross bar 17 rotates the pinions 45 to move the movable bars 46, which mesh with the pinions 45, upstream or downstream in the workpiece transfer direction.

Thereby, the sections of the vacuum cup device 18 move to centers of the working stations W1 to W4 to be made offset, so that workpieces 11 can be surely mounted and dismounted to be transferred, thus obtaining the above-mentioned effect (17) likewise.

In addition, control of offset amount at this time is performed by using the controller 3 to control the rotational frequency of the motor 42 on the basis of output from the encoder 43.

Also, the following effect is provided by the crossover type offset device 40:

(18) That is, the provision of the crossover type offset device 40 on the cross bar 17 enables the constitution composed of one motor 42 and one encoder 43 to make the same inexpensive. Also, the use of one motor 42 makes it hard for offset amounts to generate errors, and can make transfer of workpieces 11 favorable because no torsional force acts on the cross bar 17 even if an error generate.

[Fourth Embodiment]

Figure 14:
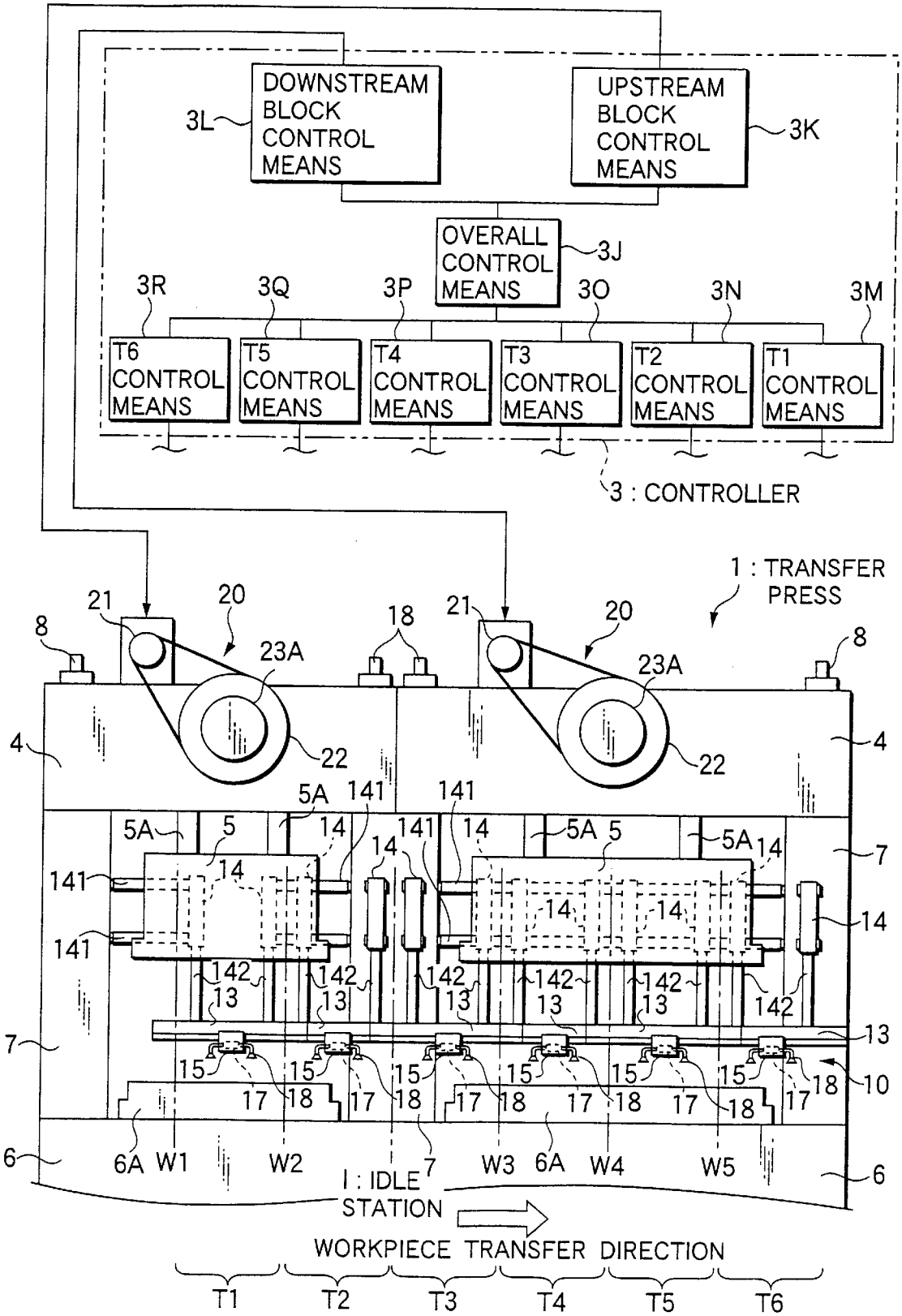
FIG. 14 is a front view showing a transfer press according to a fourth embodiment of the invention.
Figure 15:
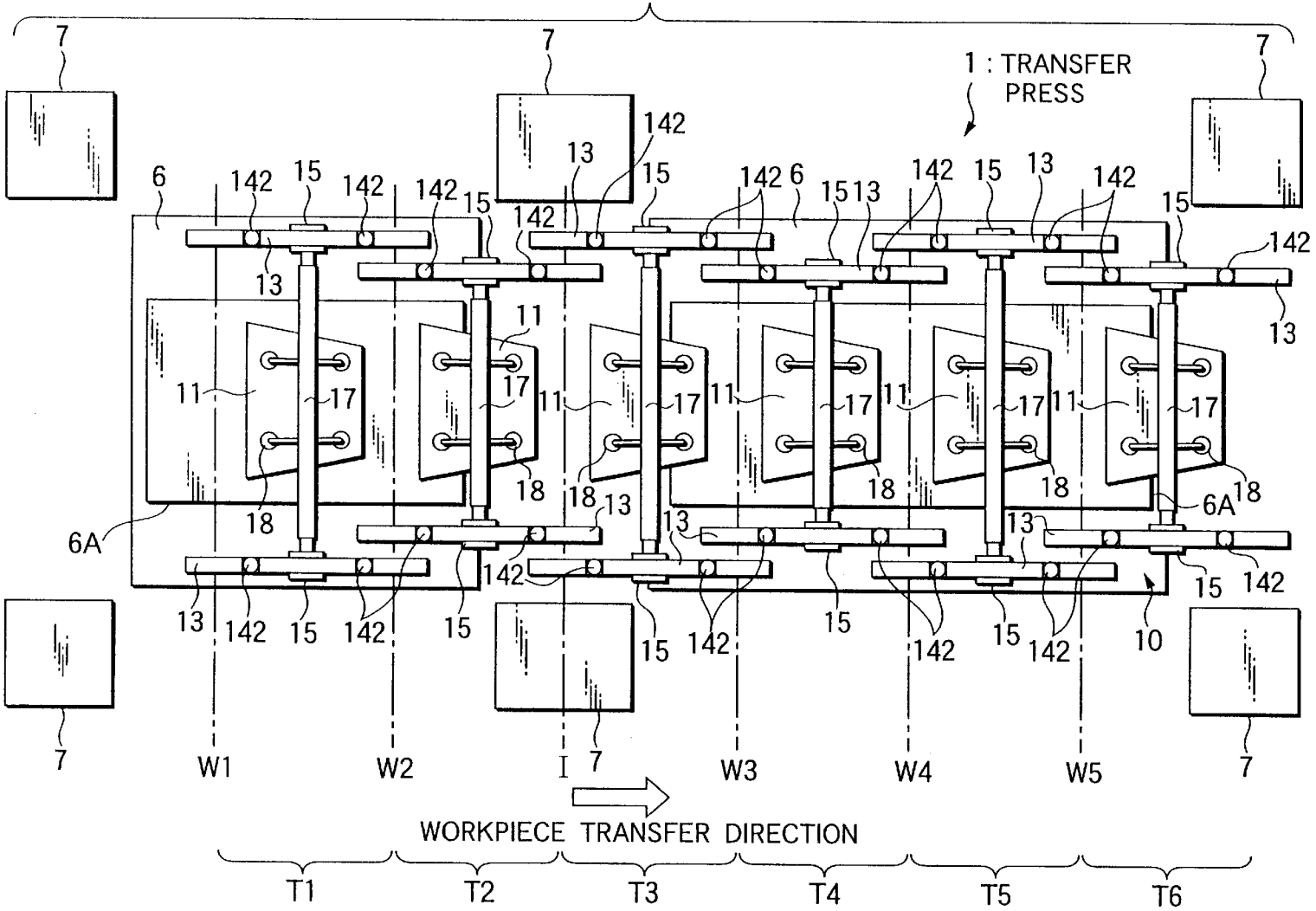
FIG. 15 is a plan view showing the transfer press of the fourth embodiment.

FIG. 14 is a front view showing another transfer press 1, which is different from that in the first embodiment of the invention. FIG. 15 is a plan view showing the transfer press 1.

In FIGS. 14 and 15, the transfer press 1 comprises a plurality (five locations) of working stations W1 to W5, and two slides 5, that is, an upstream-side slide 5 corresponding to the working stations W1, W2, and a downstream-side slide 5 corresponding to the working stations W3 to W5.

Arranged in the transfer press 1 are a controller 3 (FIG. 14) as control means composed of a control panel and an operating panel, a transfer feeder 10, and a stacking device (not shown) for feeding of workpieces.

Uprights 7 are provided on an upstream side, a substantially middle portion and a downstream side of the transfer press 1, and areas upstream and downstream of the central upright 7 are referred to as an upstream block and a downstream block, respectively. Also, the transfer press 1 is composed of crowns 4, in which a drive force transmitting mechanism such as a crank mechanism, an eccentric mechanism or a linkage mechanism is housed every block, slides 5 each provided every block to be connected to the drive force transmitting mechanism in the crown 4 through a plunger 5A and mounting thereon an upper mold, and beds 6, in which moving bolsters 6A every block mounting thereon lower molds can be received. Tie rods 8 extend vertically through the uprights 7, and are used to connect together the crowns 4, beds 6 and the uprights 7.

In addition, metallic molds are omitted in the respective figures. Also, the number of blocks is not two composed of the upstream and downstream block, but may be three or more. Also, the crowns 4, slides 5, and beds 6 and the uprights 7 in the respective blocks are not fabricated as a unit, but are uniquely fabricated as parts of the entire transfer press 1, in which point the constitution is considerably different from that in the first embodiment.

As shown in FIG. 14, the slides 5 are driven by slide drives 20 provided every block.

The slide drives 20 comprise a main motor 21 as a drive source, a flywheel 22 rotated by the main motor 21, a clutch 23A for intermittently transmitting rotational energy of the flywheel 22 to the drive force transmitting mechanism in the crown 4, and a brake (not shown) for stopping movements (slide motion) of the slide 5, the slide drives being arranged on, for example, upper sides of the crowns 4.

The controller 3 serves to control the slide drives 20 for driving of the slides 5, and comprises an upstream block control means 3K and a downstream block control means 3L, which individually control the slide drives 20 every block, and an overall control means 3J for controlling these control means overall, the controller being fabricated by the control technique making use of a computer.

Each of the control means 3K, 3L in the respective blocks has the function equivalent to that of control means in general single presses, and controls one of the slide drives 20 irrespective of the other of the slide drives 20 to drive the slides 5 singly.

The overall control means 3J functions to controllingly link the control means 3K, 3L, and controls the slide drives 20 in the respective blocks to synchronously drive the respective slides 5 without phase difference or under different conditions.

Accordingly, such controller 3 enables <1> control for synchronously driving the slides 5 in both blocks without phase difference (synchronous drive mode without phase difference), <2> control for optionally setting drive conditions of the slides 5 in the both blocks to synchronously drive the slides together (synchronous drive mode under different conditions), <3> control for singly driving the slides 5 in the both blocks (single drive mode), and <4> control (multi-drive mode), in which synchronous drive without phase difference, synchronous drive under different conditions and single drive are combined optionally, and the control means 3K, 3L enable maintaining the slides 5 in stoppage when the slides 5 are driven singly.

And in the controller 3, any one of the drive modes is selected by way of the operating panel or the like to start up the control means (3J to 3L) conformed to a selected drive mode to control the operation of the transfer press 1. Also, the controller 3 is provided with T'1 to T'6 control means 3M to 3R for controlling the transfer feeder 10. These control means have the same function as those of the T1 to T4 control means 3F to 3I (FIG. 1), and such function has been described, so an explanation therefor is omitted here.

According to the present embodiment, the same effect as that described with respect to the first and second embodiments is provided likewise although there is a difference therebetween that the slide drives 20 are provided every one of the working stations W1 to W5 (for example, FIGS. 1 and 7) or every block. Also, the constitution peculiar to the present embodiment provides the following effect:

(19) Drawing step is in many cases first implemented in press working. Therefore, in many cases, a drive force transmitting mechanism in an upstream block adopts a linkage mechanism and a drive force transmitting mechanism in a downstream block adopts an eccentric mechanism. The linkage mechanism is constructed such that the slides 5 slowly descend and rapidly ascend so as to facilitate deep drawing. Accordingly, when the slides 5 are to descend, they descend to a level below a level required for transfer of workpieces at an early timing, which makes it difficult for transfer of workpieces to be performed in a manner not to interfere with the slides. Hereupon, in the present embodiment, the slides 5 in the respective blocks are driven by separate slide drives 20 in synchronous drive, in which the upstream block is later in phase than the downstream block, whereby transfer of workpieces can be balanced in timing between the upstream block and the downstream block, in which the eccentric mechanism is used.

Also, with the transfer press 1 in the present embodiment, the slide 5 in the downstream block is stopped a predetermined time every cycle at a top dead point whereby transfer of workpieces can be balanced in timing between the downstream block and the upstream block, in which the linkage mechanism is used.

In addition, the invention is not limited to the respective embodiments described above but contains other constitutions capable of attaining the object of the invention and including the following modifications.

Figure 12:
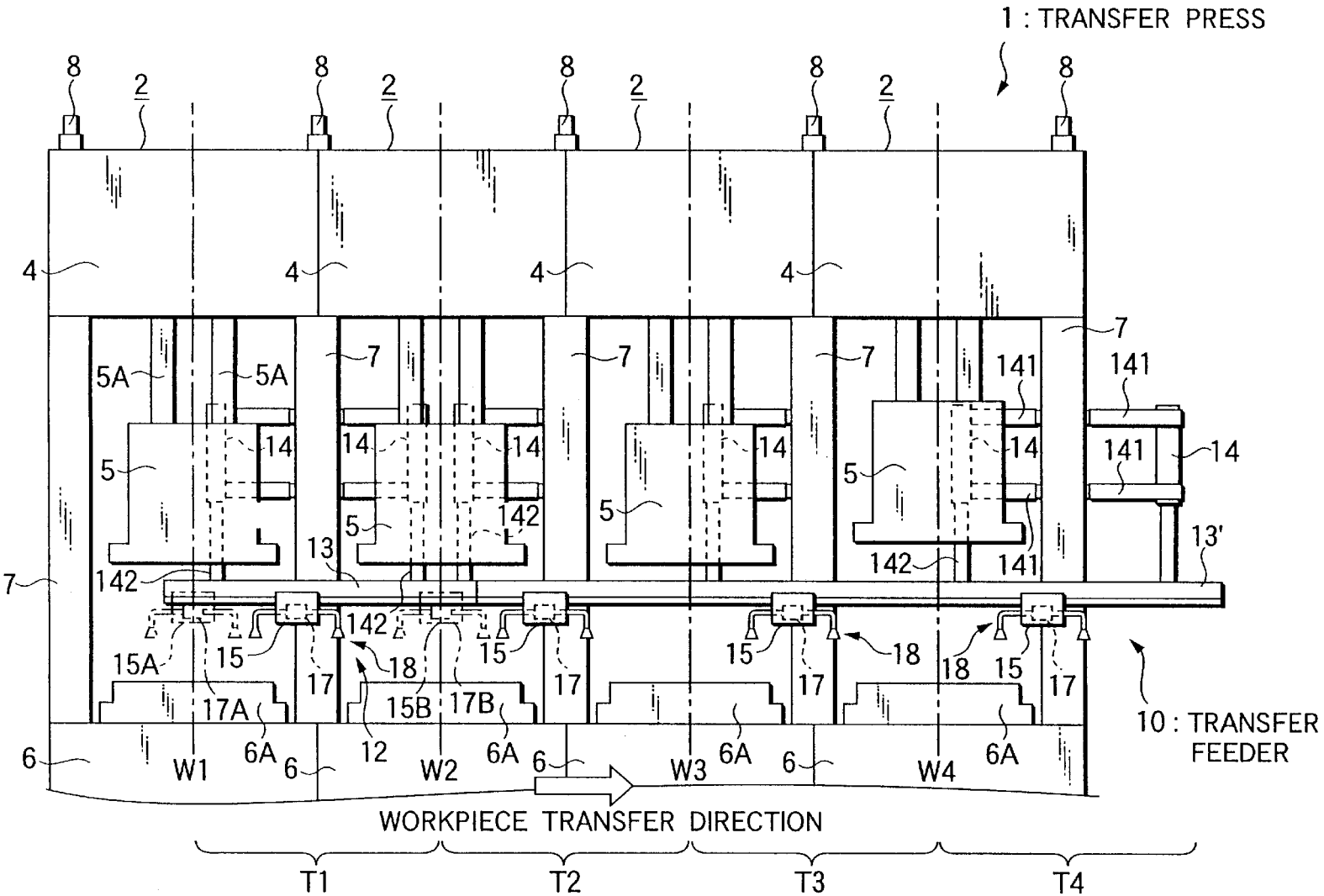
FIG. 12 is a front view showing a modification of the invention.
Figure 13:
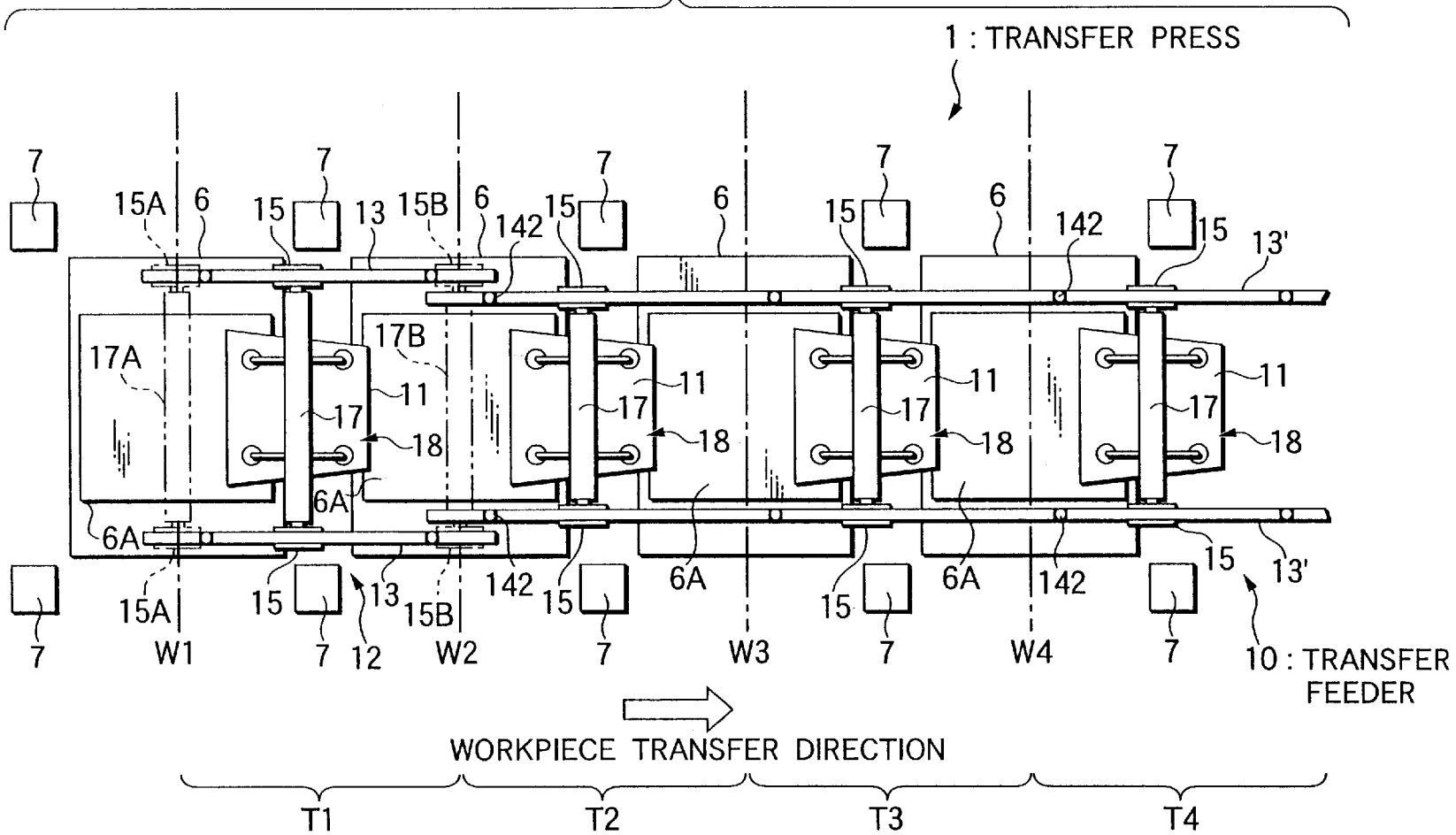
FIG. 13 is a plan view showing the above modification.

For example, while the transfer feeders 10 in the first and second embodiments comprise a pair of lift beams 13 every one of the transfer areas T1 to T4, the transfer feeder according to the invention may include two or more pairs in total, that is, a pair on the upstream side and a pair on the downstream side. Accordingly, while a pair of lift beams 13 are provided in the transfer area T1 as shown in, for example, FIGS. 12 and 13, lift beams extending over a plurality of transfer areas may be used such that a pair of continuous lift beams 13' are provided in the transfer areas T2 to T4.

In this case, however, it is desirable to provide every one of the transfer areas T1 to T4 a pair of carriers 15 for moving of the vacuum cup device 18 and a cross bar 17 bridging across the carriers in order to perform transfer of workpieces 11.

Also, other operating configuration for operation of the transfer press 1 and the transfer feeder 10 than the operating configurations A to E described in the respective embodiments are as follows:

More specifically, the transfer press and the transfer feeder, respectively, are operated in "multi-drive mode" such that the slides 5 the working stations W1, W2 and in the transfer areas T1, T2 are operated in "synchronous drive under different conditions" and the lift beams 13 and the carriers 15 are operated in "synchronous drive under different conditions", whereby the press units 2 and the feed units 12 are caused to function as a tandem press line. Also, all the members are stopped in the working station W3 and in the transfer area T3 to be used for stacking of workpieces. Further, the slide 5, the lift beams 13 and the carriers 15 in the working station W4 and in the transfer area T4 are operated in "single drive mode" to function as a single press.

Of course, "synchronous drive without phase difference" may be effected in the working stations W1, W2 and in the transfer areas T1, T2. In a word, it is optional to implement which drive mode should be implemented in any one of the working stations W1 to W4 and the transfer areas T1 to T4.

While in the operating configuration A in the first embodiment all the slides 5 are driven in transfer working, the slides 5 in the working stations W1, W2, W4 except the working station W3 are driven in "synchronous drive without phase difference" and the slide 5 in the working station W3 is stopped in the case where, for example, the working station W3 is used as an idle working station even when transfer working is to be performed. And the lift beams 13 and the carriers 15 in all the transfer areas T1 to T4 may be driven in "synchronous drive without phase difference".

Also, while the main motor 21 itself stops in the press unit 2, in which the slide 5 is not driven, as described in the operating configuration D in the first embodiment, the slide drive method according to claim 4 of the invention covers the case where the main motor 21 and the flywheel 22 are driven and the slide 5 is maintained in stoppage by controlling the clutch and the brake 23. However, it is desired in terms of energy saving that the main motor 21 itself be stopped.

While the main motors 21 are used as a drive source according to the invention in the respective press units 2 in the above-mentioned embodiments, the respective press units 2 may be constituted as free-motion presses, in which slide motions can be set optionally, by the use of hydraulic cylinders, servomotors or the like as drive sources. And also in this case, various workings can be realized because the slides 5 in the respective press units 2 are synchronously driven with optional phase difference (including the case without phase difference), synchronously driven in optional slide motions or singly driven to thereby make the press units function as a transfer press, tandem press or a single press as a whole.

What is claimed is:

1. A transfer press having a plurality of slides, comprising:

a plurality of slide drives being drive sources for respectively driving the plurality of slides; and control means for synchronously driving the plurality of slides and for individually driving an individual slide differently from other slides of the plurality of slides by controlling the plurality of slide drives.

2. The transfer press according to claim 1, wherein each of the plurality of drive slides includes a motor.

3. A method of driving slides of a transfer press provided with a plurality of slides, comprising the steps of:

driving the plurality of slides respectively by means of a plurality of slide drives; and controlling the plurality of slide drives to synchronously drive the plurality of slides and to individually drive an individual slide differently from other slides of the plurality of slides.

4. The method according to claim 3, wherein other slides of the plurality of slides are driven, while any one slide of the plurality of slides is stopped and the slide drive of a plurality of slide drives corresponding to the one-stop slide is stopped.

5. The method according to claim 3, wherein when at least a pair of slides of the plurality of slides are synchronously driven, the plurality of slide drives are controlled so that at least one slide of the pair of slides is synchronously driven while stopping a predetermined time every cycle at a top dead point.

6. The method according to claim 3, wherein in the case when at least a pair of slides of the plurality of slides are synchronously driven, the plurality of slide drives are controlled so that the pair of slides are synchronously driven with a phase difference.

7. The method according to claim 3, wherein each of the plurality of drive slides includes a motor.

8. The method according to claim 3, wherein other slides of the plurality of slides are driven, while any one slide of the plurality of slides is stopped.

9. The method according to claim 5, wherein other slides of the plurality of slides are driven, while any one slide of the plurality of slides is stopped.

10. The method according to claim 5, wherein in the case when at least a pair of slides of the plurality of slides are synchronously driven, the plurality of slide drives are controlled so that the pair of slides are synchronously driven with a phase difference.

11. The method according to claim 5, wherein other slides of the plurality of slides are driven, while any one slide of the plurality of slides is stopped and a drive slide of the plurality of slide drives corresponding to the one stopped slide is stopped.

12. The method according to claim 10, wherein other slides of the plurality of slides are driven while any one slide of the plurality of slides is stopped.

13. The method according to claim 10, wherein other slides of the plurality of slides are driven, while any one slide of the plurality of slides is stopped and a drive slide of the plurality of slide drives corresponding to the one stopped slide is stopped.

14. The method according to claim 6, wherein other slides of the plurality of slides are driven, while any one slide of the plurality of slides is stopped and a drive slide of the plurality of slide drives corresponding to the one stopped slide is stopped.

15. The method according to claim 6, wherein other slides of the plurality of slides are driven, while any one slide of the plurality of slides is stopped.

16. A method of driving slides of a transfer press, in which a plurality of units each composed of a crown, a slide and a bed are arranged along a workpiece transfer direction and uprights are provided between adjacent units to be common thereto, comprising the steps of:

driving a plurality of slides respectively by means of a plurality of slide drives; and controlling the plurality of slide drives to synchronously drive the plurality of slides and to individually drive an individual slide differently from other slides of the plurality of slides.

17. The method according to claim 16, wherein in the case when at least a pair of slides of the plurality of slides are synchronously driven, the plurality of slide drives are controlled so that the pair of slides are synchronously driven with a phase difference.

18. The method according to claim 16, wherein other slides of the plurality of slides are driven, while any one slide of the plurality of slides is stopped.

19. The method according to claim 16, wherein other slides of the plurality of slides are driven, while any one slide of the plurality of slides is stopped and a drive slide of the plurality of slide drives corresponding to the one stopped slide is stopped.

20. The method according to claim 16, wherein when at least a pair of slides of the plurality of slides are synchronously driven, the plurality of slide drives are controlled so that at least one slide of the pair of slides is synchronously driven while stopping a predetermined time every cycle at a top dead point.

21. The method according to claim 16, wherein each of the plurality of drive slides includes a motor.

22. A transfer press, in which a plurality of units each composed of a crown, a slide and a bed are arranged along a workpiece transfer direction and uprights are provided between adjacent units to be common thereto, comprising:

a plurality of slide drives being drive sources for respectively driving a plurality of slides; and control means for controlling the plurality of slide drives to synchronously drive the plurality of slides and to individually drive an individual slide differently from other slides of the plurality of slides.

23. The transfer press according to claim 22, wherein each of the plurality of drive slides includes a motor.

* * * * *